United States Patent [19]

O'Keefe et al.

[11] Patent Number: 4,520,356

[45] Date of Patent: May 28, 1985

[54] DISPLAY VIDEO GENERATION SYSTEM FOR MODIFYING THE DISPLAY OF CHARACTER INFORMATION AS A FUNCTION OF VIDEO ATTRIBUTES

[75] Inventors: David B. O'Keefe, Westford; Robert C. Miller, Braintree, both of Mass.

[73] Assignee: Honeywell Information Systems Inc., Waltham, Mass.

[21] Appl. No.: 409,774

[22] Filed: Aug. 20, 1982

Related U.S. Application Data

[63] Continuation of Ser. No. 159,417, Jun. 16, 1980, abandoned.

[51] Int. Cl.[3] ..... G09G 1/00

[52] U.S. Cl. ..... 340/750; 340/703; 340/717; 340/723; 178/15

[58] Field of Search ..... 340/750, 748, 744, 703, 340/717, 723, 803, 749; 178/15, 30

[56] References Cited

U.S. PATENT DOCUMENTS

| | | | |
|---|---|---|---|
| 3,426,344 | 2/1969 | Clark | 340/750 |
| 3,895,375 | 7/1975 | Williams | 340/723 |
| 3,925,776 | 12/1975 | Swallow | 340/717 |
| 3,944,997 | 3/1976 | Swallow | 340/717 |
| 4,258,361 | 3/1981 | Hydes et al. | 340/735 |
| 4,310,838 | 1/1982 | Juso et al. | 340/703 |
| 4,405,830 | 9/1983 | Foster et al. | 340/703 |

*Primary Examiner*—Marshall M. Curtis

*Attorney, Agent, or Firm*—William A. Linnell; Nicholas Prasinos

[57] ABSTRACT

A video generation logic for a display controller includes a precoded PROM which combines visual attributes associated with the characters of information to be displayed on the display screen to produce multiple video control signals for modifying the dot pattern generation signal which is generated in response to character information stored in a refresh memory of the display controller. Visual attribute signals are used as an address to a video attribute generation PROM to retrieve a precoded data word associated with a particular combination of video attributes and the information contained in the retrieved data word is used to provide video control signals. Some of the video control signals are combined with the dot pattern generation signal to provide a video signal which is transmitted to the display monitor which displays the character information. One of the video attribute signals is a low intensity signal, which in the case of a character not having any other visual attributes selected, would result in the character of information being displayed in a reduced intensity level on the screen of the display monitor. Before transmission to the display monitor, this low intensity signal is modified by the video attribute generation PROM as a function of the other selected video attributes.

11 Claims, 12 Drawing Figures

DISPLAY CONTROLLER AND DISPLAY MONITOR LOGIC

DISPLAY CONTROLLER AND DISPLAY MONITOR LOGIC

DISPLAY CONTROLLER AND DISPLAY MONITOR LOGIC

SHEET 1 OF 2

DISPLAY CONTROLLER AND DISPLAY MONITOR LOGIC

SHEET 2 OF 2

TRANSMIT LOGIC AND RECEIVE LOGIC

VIDEO GENERATION LOGIC

REFRESH MEMORY DATA FORMAT

CHARACTER CELL SCAN DOTS

SCAN LINE 12 INDICATOR

| LOCATION ADDRESS (HEX) | PROM BITS 1 (2') | 2 (3') | 3 (4') | 4 (5') | 5 (6') | 6 (7') | 7 (8') | 8 | CHARACTER CELL SCAN LINES |
|---|---|---|---|---|---|---|---|---|---|
| 40F | | | | | | | | | |
| 410 | | | | | | | | | 1 |
| 411 | | | 0 | 0 | 0 | | | | 2 |
| 412 | | 0 | 0 | | 0 | 0 | | | 3 |
| 413 | 0 | 0 | | | | 0 | 0 | | 4 |
| 414 | 0 | 0 | | | | 0 | 0 | | 5 |
| 415 | 0 | 0 | | | | 0 | 0 | | 6 |
| 416 | 0 | 0 | 0 | 0 | 0 | 0 | 0 | | 7 |
| 417 | 0 | 0 | | | | 0 | 0 | | 8 |
| 418 | 0 | 0 | | | | 0 | 0 | | 9 |
| 419 | 0 | 0 | | | | 0 | 0 | | 10 |
| 41A | | | | | | | | | 11 |
| 41B | | | | | | | | 0 | 12 |
| 41C | | | | | | | | | 13 |
| 41D | | | | | | | | | |
| 41E | | | | | | | | | |
| 41F | | | | | | | | | |
| 420 | | | | | | | | | |
| 421 | 0 | 0 | 0 | 0 | 0 | | | | |
| 422 | 0 | 0 | | | 0 | 0 | | | |

| CHAR | ASCII CODE (HEX) |
|---|---|
| @ | 40 |
| A | 41 |
| B | 42 |

DOT PATTERN GENERATOR PROM DATA FORMAT

Fig. 9

VIDEO ATTRIBUTE GENERATOR PROM DATA FORMAT

| BLKTM2 (DATA BLINK CONTROL) | BLKTM1 (CURSOR BLINK CONTROL) | DISPLAY SCREEN CHARACTER CELL |
|---|---|---|
| 0 | 0 | |
| 0 | 1 | _ |
| 1 | 0 | A |
| 1 | 1 | A |

EXAMPLE: CURSOR LOCATED IN A BLINKING CHARACTER CELL

DISPLAY VIDEO GENERATION SYSTEM FOR MODIFYING THE DISPLAY OF CHARACTER INFORMATION AS A FUNCTION OF VIDEO ATTRIBUTES

This application is a continuation of application Ser. No. 159,417, filed 6/16/80, now abandoned.

CROSS REFERENCE TO RELATED APPLICATIONS

The following patent applications, which are assigned to the same assignee as the instant application, have related subject matter and are incorporated herein by reference. Certain portion of the system and processes herein disclosed are not our invention, but are the invention of the below-named inventors as defined by the claims in the following patent applications:

| TITLE | INVENTORS | SERIAL NUMBER |
|---|---|---|
| Remote Monitor Interface | Gordon Lewis Steiner<br>David B. O'Keefe<br>Robert C. Miller | 127,671 |
| Keyboard Strobe Generation System | Robert C. Miller<br>David B. O'Keefe | 157,748 |
| Scrolling Display Refresh Memory Address Generation Apparatus | David B. O'Keefe<br>Robert C. Miller | 159,719 |

BACKGROUND OF THE INVENTION

1. Field of the Invention

This invention relates to the display of information on a cathode ray tube (CRT) monitor display. In particular, the invention pertains to apparatus which permits the display controller which generates the dot pattern comprising the characters of information to be displayed on the CRT screen to generate and modify the video control signals such that the normal video output can be modified by certain visual attributes associated with the information to be displayed.

2. Description of the Prior Art

Information is normally displayed on the cathode ray tube of a display monitor by selectively energizing an electron beam as it scans the sensitized screen of the CRT. The electron beam normally scans the screen from left to right in a succession of horizontal scan paths which begin at the top of the screen and end at the bottom of the screen. The beam is subsequently returned to the top of the screen for the next successive raster scan of the entire screen. This is accomplished by monitor electronics, or beam drive circuitry, associated with the cathode ray tube which magnetically deflects the beam in both the horizontal and vertical directions and selectively energizes the beam as it scans the screen of the CRT. The horizontal retrace of the beam is initiated by a horizontal synchronization (SYNC) signal, the vertical return of the beam to the top of the screen is initiated by a vertical sync signal and the beam is selectively energized in response to a video signal. These signals, the horizontal sync, vertical sync, and video signals are generated by the display controller and transferred to the monitor electronics which in turn uses them to generate the signals which drive the electron beam gun and beam deflection magnets.

The display controller generates the horizontal sync and the vertical sync signals by use of raster scan logic.

The video signals are generated by scanning a refresh memory in the display controller which contains the information which is to be displayed on the CRT screen. The video signals are generated by the display controller scanning the refresh memory a character at a time as each row of information is displayed on the CRT screen. The information within the display controller refresh memory may originate from a keyboard attached to the display terminal, from a computer attached to the display controller, or remotely from a communications line attached to the display controller.

In addition to generating the video and sync signals, some displays allow the information to be displayed in a variety of intensities on the CRT screen, for example, a display may allow information to be displayed in normal brightness or in a low intensity mode which is less than the normal brightness. In this case, a low intensity signal must also be generated by the display controller to control the intensity of the information on the display screen. In addition to an intensity mode which may be associated with an individual character or a field of characters which is to be displayed on the display screen, other visual attributes are often found in display systems. For example, an inverse video attribute can indicate that the character of information is to be displayed as a dark character on a light background as opposed to the normal case of a light character on a dark background. A blink video attribute allows the character of information to be blinked on the display screen to draw the display operator's attention to the information. An underline visual attribute allows the character of information in the row to be displayed with an underline under the character. A hide visual attribute results in the blocking of the video signal such that sensitive data will not be displayed on the display screen, although it is available in the refresh memory and may be transmitted or received from a computer attached to the display controller or remotely over a communication line attached to the display controller. In addition, the cursor may be treated as a visual attribute to modify the character which would otherwise be displayed on the display screen to indicate to the operator where the next character of data which is entered from a keyboard attached to the display controller will be placed on the display screen.

Because one or more of these visual attributes may be associated with any character of information to be displayed on the display screen, a large amount of combinational logic is needed to combine the various visual attributes to modify the video signal prior to it being transmitted to the CRT's electron beam gun. Besides requiring large amounts of combinational logic if many visual attributes can be associated with any character of information to be displayed on the screen, the combinational logic may result in substantial video signal propagation delay and adversely impact the synchronization of the video signal with other signals. In high resolution monitors having relatively short scan times (such as 50 nanoseconds for each dot of a character), the introduction of delays in the propagation of the video signal may require the addition of yet more logic in order to generate the video signal in a timely fasion.

The instant invention is directed to achieving an improved apparatus for generating modified video signals in response to multple video attributes associated with each individual character of information that is displayed on the display screen in a manner which will satisfy all synchronization requirements of the application and will result in substantial reduction in manufacturing costs.

OBJECT OF THE INVENTION

Accordingly, it is an object of the present invention to provide a low-cost system for generating video control signals in response to character information and video attribute information.

It is another object of the present invention to provide a video generation logic apparatus having a low manufacturing cost.

It is a further object of the present invention to provide a video generation logic apparatus which will maintain video control signals output by the display controller in synchronization such that they need not be resynchronized to correct for skew introduced by propagation delays of the attribute signals through serial-combination logic.

A still further object of the present invention is to provide a video generation logic apparatus for use with visual attributes, one of which controls the intensity at which the information is to be displayed.

This invention is pointed out with particularity in the appended claims. An understanding of the above and further objects and advantage of this invention can be obtained by referring to the following description taken in conjunction with the drawings.

BRIEF DESCRIPTION OF THE DRAWINGS

The manner in which the apparatus of the present invention is constructed and its mode of operation can best be understood in light of the following detailed description taken together with the accompanying drawings in which like reference numerals identify like elements in the several figures and in which:

FIG. 9 is a diagram illustrating the data format and a portion of the data contained in the dot pattern generator of FIGS. 4 and 7;

SUMMARY OF THE INVENTION

A video generation system for a video display controller having a refresh memory is provided wherein a video control signal is produced by combining multiple vidoe attribute control signals, multiple timing signals, and multiple scan line count signals along with encoded data signals to produce a dot pattern generation signal and minimal video control signals.

In one aspect of the invention, two control signals which are binary encoded to indicate video: block, force, normal, and inverse are combined with the output of a dot pattern generator to produce the video signal.

In another aspect of the invention, an intensity signal is modified by the status of other attribute control signals to produce a modified intensity signal which is used in conjunction with the video signal for transmission to the display monitor.

DETAILED DESCRIPTION OF THE PREFERRED EMBODIMENT

Figure 1:
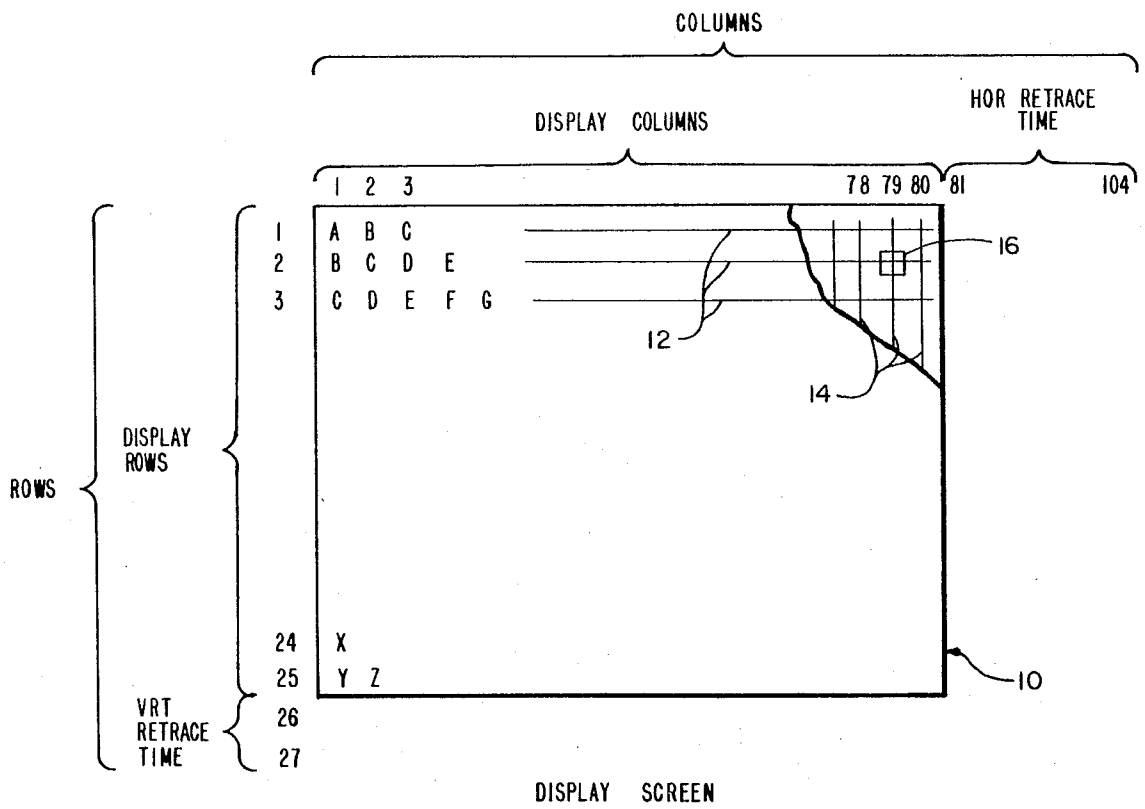
FIG. 1 is a video display of information on the display screen of a CRT.

Referring to FIG. 1, a display screen 10 is illustrated along with a particular arrangement of alphanumeric characters appearing thereon. Such a display is commonly found in computer terminals where the information is displayed on the screen for any number of purposes. It is to be noted that the alphanumeric characters appearing in FIG. 1 are arranged in a plurality of rows 12 and columns 14. In the preferred embodiment, a maximum of 80 characters are sequentially formed in columns 1 through 80 in a given row and appear on the display screen. Columns 81 through 104 as illustrated in FIG. 1 do not actually appear on the face of the display screen 10 and the time associated with them is used for the horizontal retrace of the raster scan beam between lines as described hereinafter in conjunction with FIG. 3. Also in the preferred embodiment, as illustrated in FIG. 1, there are 25 rows, rows 1 through 25, appearing on display screen 10. Rows 26 and 27 as illustrated in FIG. 1 do not appear on display screen 10 and the time associated therewith is used for the vertical retrace of the raster scan beam as will be discussed hereinafter in conjunction with FIG. 3.

Figure 2:
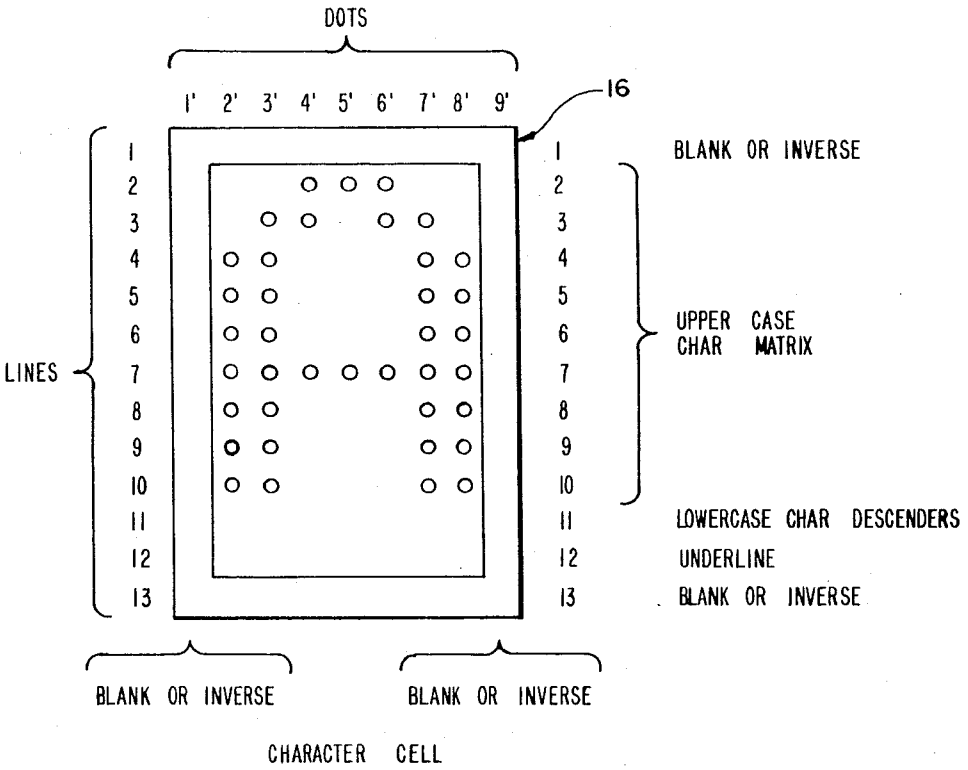
FIG. 2 illustrates the formation of a character within a character cell on the display screen of FIG. 1.

Referring now to FIG. 2, the alphanumeric character occupying the character cell 16 formed by the intersection of row 2 with column 79 on display screen 10 of FIG. 1 has been illustrated in detail. The particular alphanumeric character which is illustrated is that of the letter "A". The character cell is formed by a 9 by 13 dot matrix field. Each dot in the matrix, although illustrated in FIG. 2 as a circular spot, is actually a rectangular spot with no break between consequentive illuminated spots in the same line. Characters are formed in a character cell 16 along with other characters on the same row by sequentially illuminating appropriate dots on a number of horizontal scan lines. These horizontal scan lines are numbered 1 through 13 in FIG. 2. Dots are illuminated within these lines at dot locations denoted as 1' through 9'. In the preferred embodiment, uppercase characters are displayed in a 7 by 9 field formed by dots 2' through 8' of rows 2 through 10. Dots 2' through 8' of row 11 are used for lowercase character descenders. Line 12, dots 1' through 9' are used to underline a character. The other border of dots formed dots by 1' and 9' of lines 1 through 13 and dots 2' through 8' of lines 1 and 13 are blank when the normal image on the screen is a dark background with a character displayed with bright or lighted dots. In the normal image mode, when bright characters are displayed against a dark background, dot locations 2′ through 8′ are selectively illuminated so as to define a given line of each character as it is formed within a given row. When characters are displayed on the screen in the inverse video mode, the background of the character is light and the character is displayed as a series of dark dots in which case the outer border of dots of the character cell is a series of bright or lighted dots. In the inverse video mode, dot locations 1′ through 9′ are selectively illuminated so as to define a given line of the background of a character as it is formed within a given row.

Figure 3:
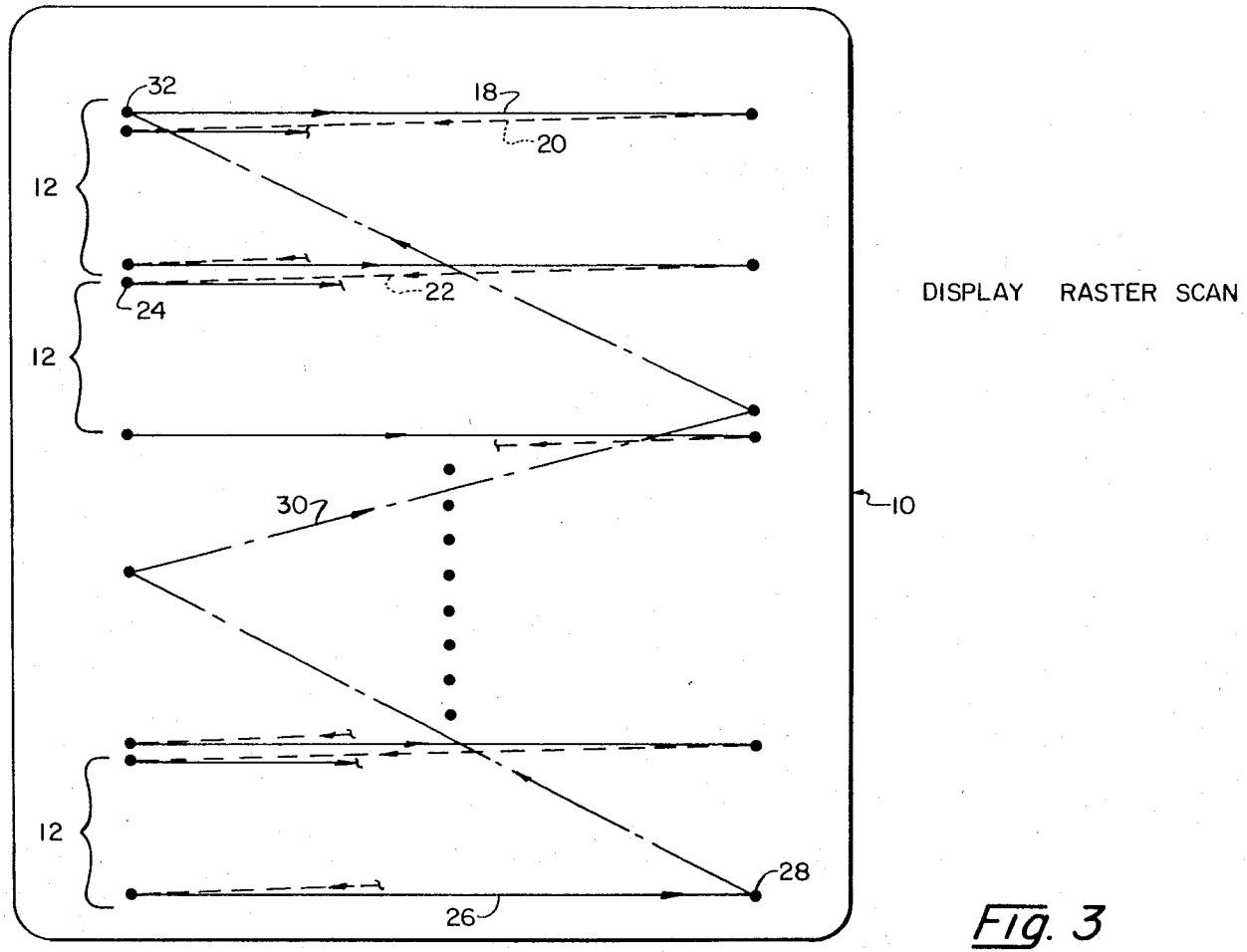
FIG. 3 illustrates the raster scan necessary to accomplish the video display of FIG. 1.

Referring now to FIG. 3, a typical raster scan is illustrated for the entire display screen 10. It is to be understood that such a raster scan would be necessary in order to form the displayed arrangement of characters in FIG. 1. In this regard, the raster scan comprises a number of individual rows such as rows 12. Each individual row comprises 33 individual horizontal scan lines such as 18. Each individual scan line is accompanied with a horizontal retrace path such as 20 which brings the electron beam back to a position for the next horizontal scan from left to right. This retrace between scan lines occurs during column times 81 through 104 as shown in FIG. 1. The next successive row of characters begins once a horizontal retrace path has been completed for the thirteenth scan line of the previous row of characters. In this regard, a retrace path 22 brings the electron beam back to a point 24 for the subsequent scan line of the next successive row. This process continues to occur until twenty-five separate rows have been formed on the display screen 10. At this time, the electron beam will have traversed a final horizontal scan line 26 in the bottommost row. When the electron beam reaches a point 28 at the end of the scan line 26, it is caused to retrace a dotted outline path 30 back to a point 32 wherein the next succession of horizontal scans begin. The dotted outline path 30 will hereinafter be referred to as the vertical retrace. During this vertical retrace which occurs during row times 26 and 27 as shown in FIG. 1, the scan path forms a zig-zag course as it travels from left to right and from right to left twenty-six times for the scan lines and horizontal retrace paths associated with row times 26 and 27 as shown in FIG. 1. Because the electron beam is not energized by a video signal during either a horizontal retrace or vertical retrace, the individual horizontal retrace paths, such as 20 and 22, and the zig-zag vertical retrace path 30 are not visible on display screen 10.

It is to be appreciated that successive raster scans must occur at a sufficient rate to refresh the displayed information on the display screen 10 of FIG. 1. In the preferred embodiment, information on display screen 10 is refreshed approximately 60 times per second with the beginning of the next scan being triggered by the completion of the previous scan and with all timing being derived from a 19.712 megahertz oscillator as discussed hereinafter with respect to FIG. 4.

Figure 4:
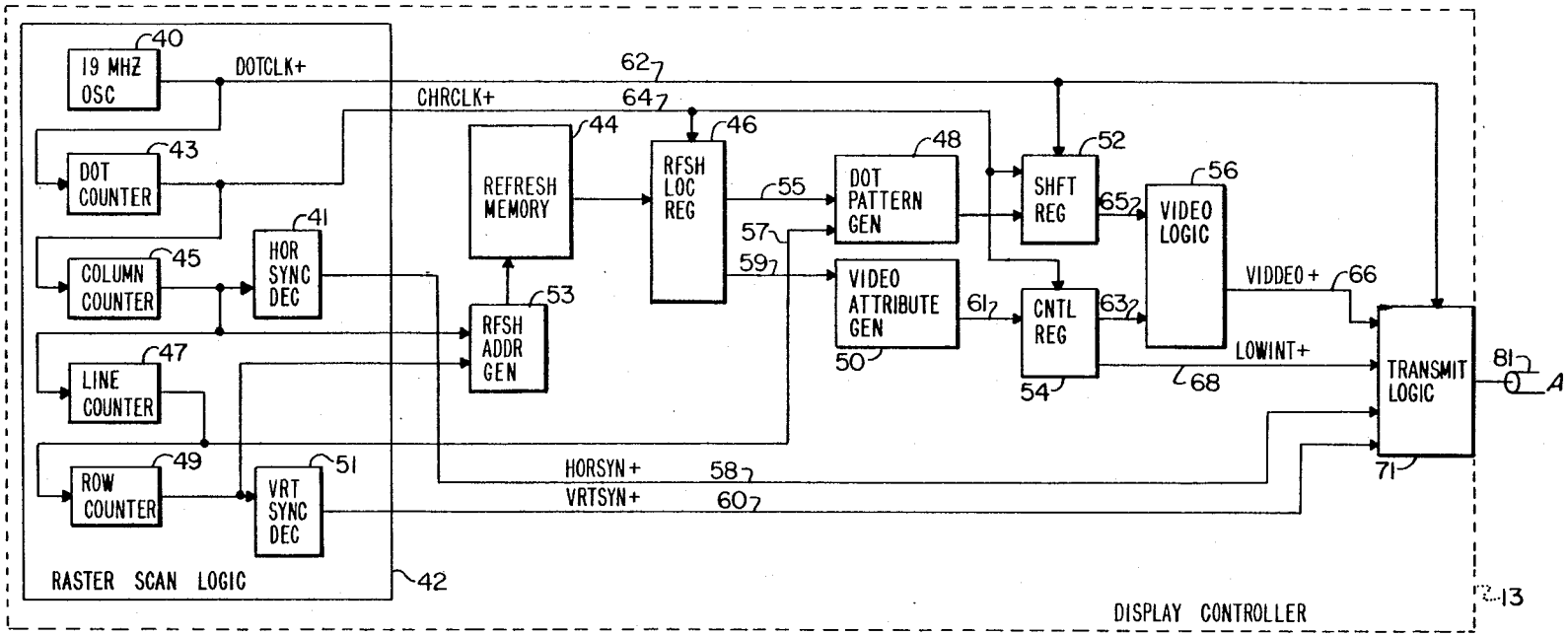
FIG. 4 is a block diagram of the display controller and display monitor logic used to form the video display of FIG. 1.
Figure 4:
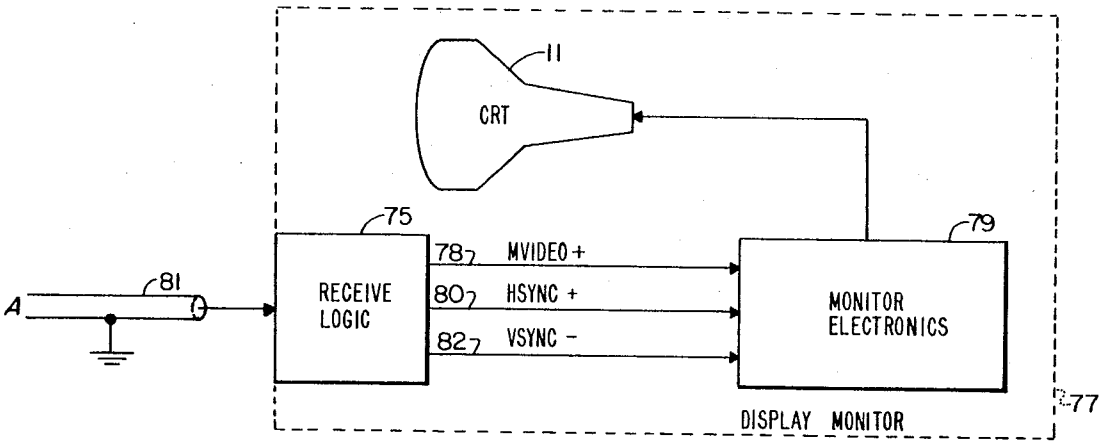

Referring now to FIG. 4, display controller 13 is operatively coupled to display monitor 77 via cable 81 such that the information contained in refresh memory 44 will be displayed on the screen of CRT 11. The exact manner in which this is accomplished will be apparent hereinafter.

The raster scan logic 42 controls the display of information through a dot clocking signal (DOTCLK+) via line 62, a character clocking signal (CHRCLK+) via line 64, a horizontal synchronization signal (HORSYN+) via line 58 and a vertical synchronization signal (VRTSYN+) via line 60. The information to be displayed on the screen of CRT 11 is retrieved from refresh memory 44 a character at a time and by the various logic of display controller 13 results in video logic 56 generating a video signal (VIDDEO+) on line 66. Along with each character of information to be displayed on the screen of the CRT 11, refresh memory 44 contains attribute information which affects how the character information is displayed on the screen of CRT 11.

In the preferred embodiment, each character of information may have the following attributes associated with the character: hide, blink, inverse video, underline and low intensity. If the hide attribute is selected, the character of information will not be displayed on the screen of CRT 11 although the character of information will remain unaffected in the refresh memory 44. If the blink attribute is selected, the character of information will be displayed on the screen of CRT 11 by flashing on and off as the image on the screen is refreshed. If the inverse video attribute is selected, the character will be displayed in the inverse video mode in which a dark character will be displayed against a light background. If the low intensity attribute is selected, the character of information will be displayed on the screen of CRT 11 in a low intensity level which is below that of the normal brightness of the character dots. If the underline attribute is selected, the character will be displayed on the screen with an underlining row of dots appearing in line 12 of the character cell 16 (see FIG. 2).

The hide, blink, inverse video and underline attributes affect the dot pattern display on the screen via video logic 56 and are reflected in video signal VIDDEO+. The low intensity attribute directly affects a low intensity signal (LOWINT+) on line 68. Video signal VIDDEO+ will be in its high state, or logical ONE state, when a dot on the screen of CRT 11 is to be generated by energizing the electron beam within display monitor 77. Low intensity signal LOWINT+ will be in the logical ONE state whenever the dots being displayed on the screen of CRT 11 are to be displayed in the low intensity (reduced brightness) mode.

The aforementioned illumination of dots occur while the electron beam is driven in a horizontal direction across the display screen 10. This is accomplished within the display monitor 77 by the beam drive circuitry of monitor electronics 79. This circuitry is responsive to the horizontal synchronization signal HSYNC+ on line 80 from receive logic 75 which is derived from the horizontal synchronization signal HORSYN+ on line 58 from raster scan logic 42 which is transmitted by transmit logic 71 on cable 81. The horizontal synchronization signal HSYNC+ appears on line 80 and is operative to initiate horizontal retrace of the electron beam as well as the subsequent horizontal scan of the individual lines by the electron beam. It is noted that the display controller 13 is operative to disable the generation of a high level video signal VIDDEO+ during such horizontal retraces such that the retrace pass is not visible on display screen 10.

The raster scan logic is also operative to initiate a vertical retrace of the electron beam within display monitor 77. A vertical retrace is initiated by vertical synchronization signal VRTSYN+ on line 60 from raster scan logic 42 going to a high state. The signal is transmitted by transmit logic 71 via cable 81 to receive logic 75 which in turn results in the video synchronization signal VSYNC− on line 82 going to a low level which in turn causes the vertical beam drive circuitry within monitor electronics 79 to move the electron beam back to the top of display screen 10. Logic within display controller 13 also inhibits the generation of a high level video signal VIDDEO+ during this vertical retrace thereby inhibiting the zig-zag vertical retrace pattern being visible on display screen 10.

It is to be understood that certain of the heretoforementioned elements within FIG. 4 are well known in the art and will therefore not be disclosed in detail herein. In particular it is to be noted that CRT 11 and monitor electronics 79 may be obtained commercially from Ball Brothers Research Corporation, Electronic Display Division, St. Paul, Minn. 55166.

The display controller 13 of FIG. 4 will now be discussed in further detail. Raster scan logic 42 provides a display controller 13 with dot times, character times, line times, and row times. The raster scan logic 42 begins with a continuous 19.712 magahertz oscillator 40 which drives dot counter 43. Oscillator 40 provides a dot clocking signal (DOTCLK+) on line 62 and also provides the input to dot counter 43. This dot time is input to dot counter 43 which divides the dot count by 9, which is the width of the character cell in dots per horizontal scan line, by generating a cyclical dot count of 0 through 8 to produce a character clocking signal (CHRCLK+) on line 64. This character time is input to column counter 45 which divides the column count by 104, which is the number of columns in a horizontal scan line (see FIG. 1), by generating a cyclical count of 0 through 103. The column count output by column counter 45 is input to horizontal synchronization decoder 41 which decodes column counts 80 through 103 and generates a horizontal synchronization signal (HORSYN+) on line 58. Signal HORSYN+ is in the low state during column counts 0 through 79 (corresponding to columns 1 through 80 of FIG. 1) when information is to be displayed on display screen 10 and in the high state during column counts 80 through 103 (corresonding to columns 81 through 104 of FIG. 1) when the horizontal retrace is to occur. The output of column counter 45 is also input to line counter 47 which divides the line count by 13, which is the number of lines per row (character cell, see FIG. 2) by generating a cyclical count of 0 through 12. The output of line counter 47 is input to row counter 49 which divides the row count by 27, which is the number of rows in a vertical scan of the display screen (see FIG. 1), by generating a cyclical count of 0 through 26. The row count output of row counter 49 is input to vertical synchronization decoder 51 which decodes row counts 25 and 26, and generates a vertical synchronization signal (VRTSYN+) on line 60. Signal VRTSYN+ is in the low state during row counts 0 through 24 (corresponding to rows 1 through 25 of FIG. 1) when information is displayed on display screen 10 and in the high state during row count 25 and 26 (corresponding to rows 26 and 27 of FIG. 1) when the vertical retrace is to occur.

Thus as described hereinbefore, the first 80 column counts represent characters actually displayed on the display screen 10 and the next 24 counts are used for the horizontal retrace and do not cause characters to be displayed. The first 25 rows of characters represent rows which are displayed on a display screen 10 and the last 2 rows are used during the vertical retrace time.

The column count output by column counter 45 and the row count output by row counter 49 are input to refresh address generator 53 which generates an address in refresh memory 44 which identifies which memory location within the refresh memory containing the character information and attribute information associated with the character which is to be displayed for a particular character cell. The 16-bit words are read from refresh memory 44 and clocked into refresh local register 46 by character clocking signal CHRCLK+. Seven bits of each 16-bit word are used to contain the ASCII code for the character which is to be displayed on the screen and are fed to dot pattern generator 48 on line 55 to get the dot pattern of a line within the dot matrix associated with the information character to be displayed. The output of line counter 47 on line 57 is also input to dot pattern generator 48 so that the dot pattern associated with each particular line of the character cell can be generated as the horizontal scan progresses from scan line to scan line. The output of pattern generator 48 is loaded into shift register 52 by character clocking signal CHRCLK+ on line 64. After the dot pattern associated with the current line of the character cell is loaded into shift register 52, it is shifted one dot at a time by dot clocking signal DOTCLK+ on line 62 so that the output signal on line 65 follows the horizontal scan of the electron beam as it progresses across the dots of the character cell. Other bits from the 16-bit word from refresh memory 44 indicates the video attributes associated with the character and are fed from refresh local register 46 on line 59 into video attribute generator 50. Video attribute generator 50 provides output signals which indicate: normal video, inverse video, and intensity level. These video attribute signals on line 61 are clocked into control register 54 by character clocking signal CHRCLK+ because these signals remain constant for each of the 9 dots associated with the horizontal scan line of a particular character cell. The normal and inverse video control signals on line 63 are combined along with the output of shift register 52 on line 65 by video logic 56 to provide a video signal (VIDDEO+) on line 66. This video signal VIDDEO+ is clocked into transmit logic 71 by dot clocking signal DOTCLK+ along with the low intensity signal from control register 54, and the horizontal synchronization signal HORSYN+ and the vertical synchronization signal VRTSYN+ from raster scan logic 42. These four TTL level signals are converted into signal levels suitable for transmission over cable 81 to receive logic 75 which converts the signals back to TTL level signals and generates a modulated video signal MVIDEO+, and horizontal synchronization signal HSYNC+ and vertical synchronization signal VSYNC−. This conversion from TTL level signals before transmission over cable 81 and reconversion to TTL level signals after transmission over cable 81 is necessary because of the fact that cable 81 exceeds the relatively short distance of 1 or 2 feet over which TTL level signals can be reliably transmitted.

Before describing transmit logic 71 and receive logic 77 in detail, a critical design objective will be discussed. In the transmission of multiple signals between two points, it is particularly important that the synchronization between the signals be maintained. In the preferred embodiment, in which four signals are transmitted from display controller 13 to the display monitor 77, it is important that the synchronization between the video, intensity, horizontal synchronization and vertical synchronization signals be maintained. This is particularly the case for high resolution display monitors of the type employed in the preferred embodiment of the instant invention if the characters of information displayed on the screen are to be stable, clear and clean and not fuzzy. In the preferred embodiment, the time it takes for the horizontal scan of the electron beam to scan the length of one dot of the character matrix is approximately 50.7 nanoseconds, this time representing the outer limits by which the signal may be out of synchronization without seriously affecting the clarity of the image on the display screen. As discussed hereinafter, empirical tests have shown that the maximum permissible missynchronization, or skew, of the signals is in fact 16 nanoseconds from dot scan times of 50.7 nanoseconds.

Figure 5A:
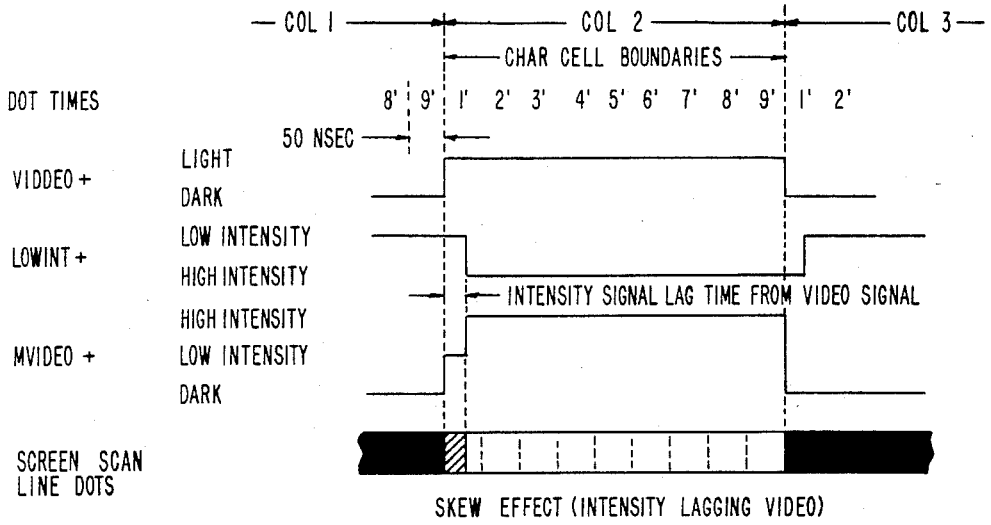
FIGS. 5A and 5B are diagrams illustrating the effect of skew between the video signal and intensity signal on a horizontal scan line of the character cell of FIG. 2.
Figure 5B:
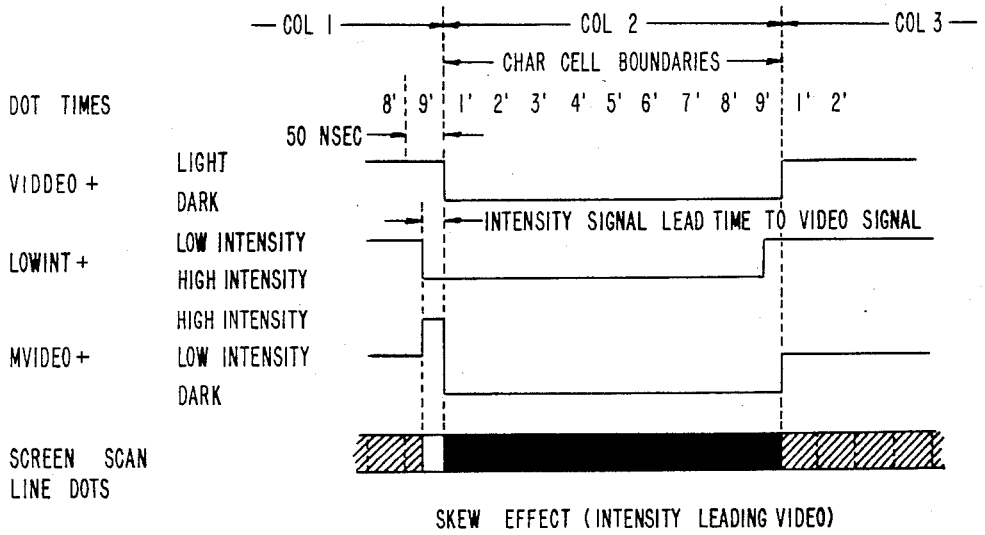

Within the preferred embodiment, the maintenance of synchronization between the video signal and the intensity signal is the most critical. Now referring to FIGS. 5A and 5B, two cases of signal skew will be discussed. FIG. 5A illustrates the case in which the intensity signal lags the video signal and FIG. 5B illustrates the case in which the intensity signal leads the video signal.

Referring now to FIG. 5A, the case in which the intensity signal lags the video signal will be discussed. In this case, the video signal arrives first and turns the video on to the low intensity state associated with the previous character cell, and sometime later the high intensity signal for the current character cell arrives. This results in the first dot of the current character cell being displayed in two intensities (low then high). FIG. 5A illustrates the dot times associated with: a trailing edge of a character cell in column 1 of display screen 10 (see FIG. 1), a full character cell in column 2, and a leading edge of a character cell in column 3. Video signal VIDDEO+ found on line 66 of FIG. 4 is illustrated such that when the signal is in the low state, logical ZERO, the electron beam of CRT 11 will not illuminate a dot on the display screen 10 and when in the high state, logical ONE, will illuminate a dot on display screen 10. Intensity signal LOWINT+ is illustrated such that when the signal is in the high state, logical ONE, any dot being displayed on the screen is to be displayed in low intensity (medium brightness) and when in the low state, logical ZERO, any dot being displayed on the screen is to be displayed in the high intensity (full brightness). Modulated video signal MVIDEO+ is a signal found on line 78 Signal MVIDEO+ is a composite of the video and intensity signals and is generated by receive logic 75 as will be discussed hereinafter with respect to FIG. 6.

Although the monitor electronics 79 used in the preferred embodiment is designed to have a video input signal in either a high state or a low state, thereby producing an image on the display screen 10 of CRT 11 in either a dark (no illumination) or light (full brightness) dot, it has been found that by biasing the video input signal into an intermediate voltage level between the voltage level used to indicate a dark dot on the screen and the voltage level used to indicate a full brightness dot on the screen that a dot of intermediate intensity can be generated. Thus a low voltage level video signal produces no dot on the screen (i.e., a dark dot), an intermediary voltage level produces a low intensity (medium brightness) dot and a high voltage level produces a high intensity (full brightness) dot on the display screen. Thus in the preferred embodiment, modulated video signal MVIDEO+ when in the high voltage range of 3.0 to 4.0 volts DC will produce a high intensity (full brightness) dot on the screen, when in the low voltage range of 0.0 to 0.4 volts DC will produce a no dot (dark dot) on the screen, and when at an intermediate voltage level between 0.4 and 4.0 volts DC will produce a low intensity (medium brightness) dot on the screen. The exact voltage level used as input to the monitor electronics 79 for the low intensity video signal is determined by adjusting a variable resistor as discussed hereinafter with respect to FIG. 6.

The screen scan line dots illustrated in FIG. 5A represent the horizontal scan line of dots formed on the display screen 10 of CRT 11 as a result of monitor electronics 79 receiving the illustrated modulated video signal MVIDEO+. In the scan line of dots, those portions of the scan line illustrated in black will be displayed as dark spots on the display screen, those portions illustrated by hash marks will be displayed in low intensity on the display screen and those portions illustrated in white will be displayed in high intensity on display screen 10.

As illustrated in FIG. 5A, the video signal VIDDEO+ corresponds to the case in which dots 1' through 9' in column 2 are to be light and dots 8' and 9' of column 1 and dots 1' through 2' of column 3 are to be dark. Referring now to FIG. 2, it can be appreciated that this video signal corresponds to the case in which the underline line, line 12 of the character cell, is being scanned and the character in column 1 is not underlined, the character in column 2 is underlined, and the character in column 3 is not underlined. This case is chosen because the critical problems between the synchronization of the intensity and video signals occur at the character cell boundaries and the underlining of a character is a case in which dots in 1' and 9' are illuminated. In the preferred embodiment, the most critical case occurs in the dots along the character cell boundaries because the intensity signal only changes at the character cell boundaries since the all dots within a character cell are displayed at the same intensity level. That is, within a given character cell the matrix is composed of either high intensity dots and dark dots or of low intensity dots and dark dots.

Referring to the low intensity signal in FIG. 5A, signal LOWINT+, it can be appreciated that the character in column 1 is to be displayed in low intensity, the character in column 2 is to be displayed in high intensity, and the character in column 3 is to be displayed in low intensity. Although in the preferred embodiment the low intensity signal will either be in the high state or low state for the full width of a character cell, the video signal may in fact change between the light state and the dark state on an individual dot basis and is illustrated as being in the dark state for column 1 and column 3 and in the light state for column 2 because that is the shape of the video signal associated with the line 12 of the character cell for an underlined character which is surrounded by 2 characters which are not underlined.

FIG. 5A illustrates the case in which the intensity signal is skewed with respect to the video signal such that the intensity signal does not change state at the character cell boundaries but instead lags behind the video signal for approximately half the scan time of dot 1'. As will be seen hereinafter in the discussion of receive logic 75 in FIG. 6, the modulation of the video signal by the intensity signal will result in the modulated video signal MVIDEO+ shown in FIG. 5 in which the signal goes from the dark state to the low intensity state for the first half of dot 1' of column 2 and then goes to the high intensity state for the remainder of dot 1' and through dot 9' of column 2. It should be further noted that the modulated video signal MVIDEO+ changes from the high intensity state to the dark state at the character cell boundary between column 2 and column 3 in response to the video signal going from the light to the dark state. Thus it can be appreciated that the presence of the video signal in the light state will cause the modulated video signal MVIDEO+ to be either in the low intensity or the high intensity state. It is the intensity signal LOWINT+ which controls which of the two intensities the modulated video signal is in. Referring now to the scan line dots which will appear on display screen 10, it can be appreciated that the dots associated with column 1 will be dark (black in FIG. 5A) as will those associated with column 3. The dots associated with column 2, all of which will be displayed as high intensity (full brightness) dots if the video and intensity signals were in proper synchronization, will actually be displayed with the first half of the 1' dot being displayed in low intensity (hash mark in FIG. 5A) and the remainder of dots 1' through 9' being displayed in high intensity (white in FIG. 5A).

Turning now to FIG. 5B, a case similar to that illustrated in FIG. 5A will be discussed. However in this case, the intensity signal arrives first and changes the video which is already on from the low intensity state associated with the current character cell to the high intensity state associated with the next character cell, and sometime later the video signal arrives for the next character cell and turns off the video. Also the video signal in FIG. 5B is the inverse of the video signal in FIG. 5A. Thus if the video signal in FIG. 5B is again to be associated with line 12 of a character cell, the underline line, the video signal VIDDEO+ in FIG. 5B, illustrates the case in which column 1, column 2 and column 3 are displayed in the inverse video mode (i.e., dark characters are displayed against a light background) with the character in column 2 being underlined and surrounded by characters in column 1 and 3 which are not underlined. The intensity signal LOWINT+ in FIG. 5B again illustrates the case (as is in FIG. 5A) in which the characters in columns 1 and 3 are to be displayed in low intensity and the character in column 2 is to be displayed in high intensity.

As in FIG. 5A, the modulated video signal in FIG. 5B, signal MVIDEO+, is generated by receive logic 75 by combining the video (VIDEO+) and the intensity (LOWINT+) signals. The resultant modulated video signal shows that the dots associated with column 1 will be displayed in low intensity with the exception of the last half of dot 9' which will be displayed in high intensity because the low intensity signal went to the high intensity state before the video signal went to the dark state. FIG. 5B also shows that all of the dots associated with colum 2 will be displayed in the dark state and the beginning dots associated with column 3 will be displayed in the low intensity. Dot 1' of column 3 is not affected by the missynchronization of the intensity signal with the video signal because the proper intensity signal level is established before the video signal changed from dark to light.

By referring to the screen scan line dots of FIG. 5A and FIG. 5B, it can be appreciated that if the intensity signal is skewed with respect to the video signal such that it lags the video signal the beginning dots of a character cell may be affected. If the intensity signal leads the video signal, the trailing dots of a character cell will be affected. In the preferred embodiment in which the time to horizontally scan the length of one dot of a character cell is approximately 50.7 nanoseconds, it has been found, by empirical tests in which the skew between the intensity signal and the video signal could be controlled, that if the video signal and the intensity signal are not within 16 nanoseconds of synchronization that the resultant fuzziness caused by having a dot illuminated with a portion in high intensity and a portion in low intensity becomes visually objectionable to an observer. It should be noted that the degree of distortion (fuzziness) acceptable to the display screen observer is a subjective measurement.

Figure 6:
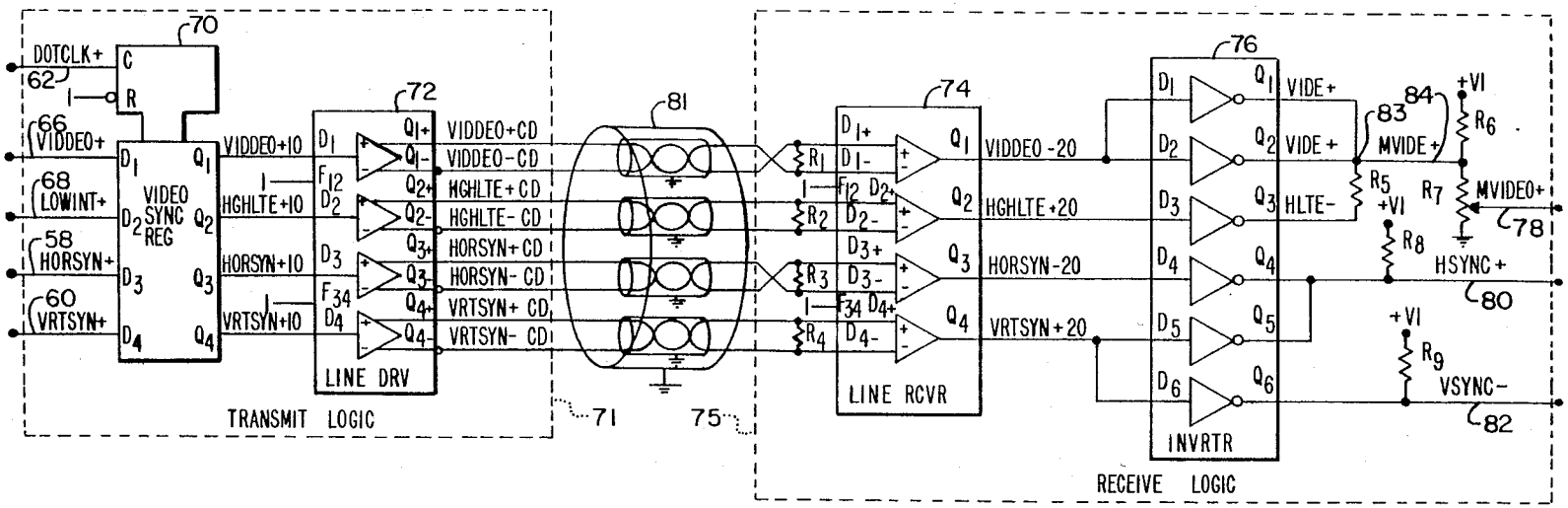
FIG. 6 is a detailed illustration of the transmit logic and receive logic of FIG. 4.

Referring now to FIG. 6, the transmit logic 71 and receive logic 75 will now be discussed in detail. Video synchronization register 70 and line driver 72 comprise transmit logic 71. A set of resistors which terminate cable 81, resistors R1 through R4, line receiver 74, inverter 76, and a second series of resistors R5 through R9 comprise receive logic 75. Transmit logic 71 takes the four information signals: video, intensity, horizontal sync, and vertical sync and transmits them to receive logic 75 via cable 81 in parallel. Receive logic 75 takes these four input signals from the display controller and maintains the synchronization between the signals, and via the second set of resistors R5 through R9, produces the three signals required as inputs to monitor electronics 79. Receive logic 75 takes the four input signals and produces the three output signals by combining the video and intensity signals into a modulated video signal (MVIDEO+) and basically passes the horizontal sync and vertical sync signals through unaltered. Thus, transmit logic 71, cable 81, and receive logic 75 are designed such that the synchronization between the signals is established in transmit logic 71 and maintained without resynchronization such that the output of receive logic 75 has maintained the synchronization between the signals within the 16 nanoseconds maximum skew limit as discussed hereinbefore with respect to FIG. 5A and FIG. 5B.

Video synchronization register 70 has as inputs: video signal VIDDEO+ on line 66, intensity signal LOWINT+ on line 68, horizontal synchronization signal HORSYN+ on line 58, and vertical sychronization signal VRTSYN+ on line 60. These four signals are clocked into the video synchronization register 70 by the dot clocking signal DOTCLK+ on line 62 transitioning from the logical ZERO to logical ONE state. In the preferred embodiment, video synchronization register 70 is a single integrated circuit comprised of multiple D-type flip-flops each of which is closed by a common clocking (C) input signal and clearable by a commom reset (R) input signal. As illustrated in FIG. 6, the reset input of video synchronization register 70 is maintained as a logical ONE such that the transition of the clocking signal from a logical ZERO to a logical ONE state will clock the inputs (D1–D4) of the D-type flip-flops to their corresponding outputs (Q1–Q4). In the preferred embodiment, video synchronization register 70 is a type SN74S174 D-type flip-flop manufactured by Texas Instruments Inc. of Dallas, Tex. and is described in their publication entitled, *The TTL Data Book for Design Engineers,* Second Edition. This type SN74S174 integrated circuit actually contains six D-type flip-flops but only four are used in the synchronizing of the signals before they are presented to line driver 72.

The signals output by video synchronization register 70, video signal VIDDEO+10, low intensity signal HGHLTE+10, horizontal synchronization signal HORSYN+10, and video synchronization signal VRTSYN+10, are in turn the inputs of line driver 72. Line driver 72 is a single integrated circuit which contains four independent driver chains which comply with EIA standards for electrical characteristics of balanced voltage digital interface circuits. The outputs of line driver 72 (Q1+ through Q4−) are three-state structures which are forced to a high impedance state when the corresponding function (F) input is a logical ZERO. In the preferred embodiment, function input F12, which controls the output of drivers 1 and 2, and function input F34, which controls the output of drivers 3 and 4, are set to a logical ONE such that the output of the driver is either a logical ZERO or a logical ONE and never in the third state (high impedance). In the preferred embodiment, line driver 72 is a type MC3487 integrated circuit manufactured by Motorola Inc. of Phoenix, Ariz. 85036.

Each driver of line driver 72 takes the TTL compatible input (D1 through D4) and produces two balanced voltage outputs (Q1+ and Q1− through Q4+ and Q4−) which are transmitted by cable 81 to receive logic 75. If the Q+ output of each driver is in the same state as the input to the driver and the Q− output is the inverted output and it is in the opposite state of the input. The outputs of line driver 72, the four pairs of signals VIDDEO+CD and VIDDEO−CD, HGHLTE+CD and HGHLTE−CD, HORSYN+CD and HORSYN−CD, and VRTSYN+CD and VRTSYN−CD which correspond respectively to the input signals VIDDEO+10, HGHLTE+10, HORSYN+10, and VRTSYN+10 are transmitted from transmit logic 71 to receive logic 75 via cable 81. Cable 81 comprises four pairs of twisted wire leads. Each of these pairs of twisted wire leads is terminated at the receive logic 75 by a resistor (R1 through R4). In the preferred embodiment, the value of the resistors R1 through R4 is 100 ohms which matches the characteristics impedance of the twisted wire transmission line of cable 81 thereby preventing reflection of the signal in cable 81. After being terminated by terminating resistors R1 through R4, the four pairs of balance voltage signals are then input to line receiver 74.

Line receiver 74 is a single integrated circuit which contains four independent receiver chains which comply with EIA standards for electrical characteristics for balanced/unbalanced voltage digital interface circuits. The outputs of line receiver 74 (Q1 through Q4) are three-state structures which are forced to a high impedance state if the corresponding function input signal (F12 or F34) is in a logical ZERO state. In the preferred embodiment, function (F) inputs F12 and F34 are maintained in the logical ONE state and therefore Q1 and Q4 will be either in a logical ONE or logical ZERO state depending upon their corresponding inputs (D1+ and D1− through D4+ and D4−). In the preferred embodiment, line receiver 74 is a type MC3486 integrated circuit manufactured by Motorola Inc. of Phoenix, Ariz. 85036.

FIG. 6 shows that the balance voltage outputs for the video signal and the horizontal synchronization signal are interchanged at the inputs of line receiver 74 such that if the video signal VIDDEO+10 is in the logical ONE state at input D1 of line driver 72 the corresponding signal VIDDEO−20 at output Q1 of line receiver 74 will be in the logical ZERO state. Similarly signal HORSYN+10 at input D3 of line driver 72 is inverted with respect to its corresponding signal HORSYN−20 at output Q3 of line receiver 74. This inversion of signals between the inputs of line driver 72 and the outputs of line receiver 74 by interchanging the balanced voltage input signals is done in order to provide signals of the required logical state at the inputs of inverter 74 and thereby eliminates any requirement for any other inverting logical element between the outputs of video synchronization register 70 and the inputs of inverter 76.

The four TTL level signals from line receiver 74 are fed into inverting amplifier 76 which provides signals at the levels required for inputs into monitor electronics 79. The primary purpose of inverting amplifier 76 is to amplify the signals from receiver 74, the inverting function could be done by reversing the polarity of the outputs of transmitter 72 with the inputs of receiver 74 as described hereinbefore with respect to signals VIDDEO+CD and VIDDEO−DC and signals HORSYN+CD and HORSYN−CD. Inverter 76 is a single integrated circuit containing six open-collector inverting amplifiers. Open-collector inverting amplifiers are used so that the low intensity signal appearing at the Q3 output of inverter 76 may be effectively subtracted from the video signal appearing at the Q1 and Q2 outputs of inverter 76 thereby providing the modulated video signal MVIDE+ on line 84. Video signal VIDDEO−20 is input to two inverters in parallel with the inverted output appearing at the Q1 and Q2 outputs of inverter 76. Two parallel inverters are used to invert the video signal so that the current flowing through each individual inverter is less than the maximum current allowable for an individual inverter. In the preferred embodiment, voltage V1 is 5 volts DC and resistor R6 is 150 ohms. The output of the inverted video signal, signal VIDE+ at the Q1 and Q2 outputs of inverter 76, is combined with the inverted low intensity signal, signal HLTE− at the Q3 output of inverter 76 at point 83. Video signal VIDE+ will be a logical ONE if a dot is to appear on display screen 10. Low intensity signal HLTE− will be a logical ZERO if the dots (all the illuminated dots in the character cell) are to be displayed on the display screen 10 in the low intensity mode and a logical ONE if the dots are to be displayed on the screen in the high intensity mode.

Combining the video signal VIDE+ with the low intensity signal HLTE− via resistor R5 at point 83 results in a modulated video signal MVIDE+ on line 84. In the preferred embodiment, resistor R5 is a 510 ohms resistor. Singal MVIDE+ on line 84 is a modulated video signal in that it is in: a high level when the video is to be displayed on the display screen 10 at full intensity, an intermediate level when the video is to be displayed on display screen 10 in an intermediate (low) intensity, and a low level when no video is to be displayed on display screen 10. This three-level modulated video signal was discussed hereinbefore with respect to FIGS. 5A and 5B. Ignoring for a moment the effect of low intensity signal HLTE−, the video signal MVIDEO+ which is supplied to the monitor electronics 79 on line 78 would normally be a high or low level signal as a function of the video signal VIDE+ at the Q1 and Q2 outputs of open-collector inverter 76 and also as a function of resistor divider network R6 and R7. In the preferred embodiment, R6 is a 150 ohms resistor and R7 is a 500 ohms variable resistor. The effect of the low intensity signal is such that, if the low intensity signal HLTE− is a logical ZERO (low voltage) at the Q3 output of open-colletor inverter 76 and the video signal VIDE+ at the Q1 and Q2 outputs of inverter 76 is a logical ONE (high voltage), current will flow through resistor R5 and reduce the voltage level at point 83 and on line 84 thus producing an intermediate voltage level modulated video signal MVIDE+. If signals HLTE− and VIDE+ are both logical ONEs (high voltage levels) indicating that a dot is to be illuminated at full brightness, no current flows through resistor R5 and modulated video signal MVIDE+ will be a high voltage level signal. In the preferred embodiment, R5 is a 510 ohms resistor. Variable resistor R7 is used to adjust the contrast between the high and low intensity dots generated on the face of display screen 10. Resistor R7 is adjusted such that the voltage level of the modulated video signal MVIDEO+ for a low intensity dot is biased to the threshold of the circuit in the monitor electronics 79 which is used to drive the video of CRT 11. This biasing of the low intensity voltage level to the threshold of the electron beam drive circuitry is necessary because in the preferred embodiment the particular monitor electronics 79 are designed for a single (adjustable for linear mode) video input. By biasing the low intensity voltage level between the light and dark voltage levels, a low intensity dot can be generated.

Horizontal synchronization signal HORSYN−20 is inverted by two parallel open-collector inverters and the output thereof at outputs Q4 and Q5 of inverter 76, signal HSYNC+ on line 80, is the horizontal synchronization signal input to monitor electronics 79. Signal HSYNC+ is a logical ONE (high voltage level), as required by the monitor electronics 79, during the time in which the horizontal retrace is taking place and a logical ZERO (low voltage level) during the time that the horizontal scan line is displaying information on display screen 10. Again, as in the case of the video signal, two parallel open-collector inverters are used so that the current in each inverter does not exceed the maximum allowable current rating of the individual inverters. In the preferred embodiment, resistor R8 is a 330 ohms resistor and again voltage V1 is +5 volts DC.

Vertical synchronization signal VRTSYN+20 is inverted by inverter 76 and produces signal VSYNC− on line 82 at the Q6 output. Vertical synchronization signal VSYNC− is a logical ONE (high voltage level) when information is being displayed on display screen 10 and in the logical ZERO (low voltage level) during the vertical retrace of the electron beam from the bottom scan line to the top scan line of display screen 10. In the preferred embodiment, resistor R9 is a 470 ohms resistor and again voltage V1 is +5 volts DC.

The logical states (ONE and ZERO) and their corresponding voltage levels of the modulated video (MVIDEO+), horizontal synchronization (HSYNC+), and vertical synchronization (VSYNC−) signals required by monitor electronics 79 are a function of the particular monitor electronics 79 employed within a given embodiment. In the preferred embodiment, modulated video signal MVIDEO+ is used by the monitor electronics to control one of the grids within CRT 11 to determine whether or not the display screen 10 is modulated to the light state or the dark state. The two brightness levels of dots on display screen 10 is achieved by biasing the video signal into a threshold region such that when a low intensity dot is required only a partial beam is generated by CRT 11. Horizontal synchronization signal HSYNC+ controls the horizontal deflection circuitry within the monitor electronics such that the electron beam is controlled to produce the horizontal scan lines and the horizontal retrace. The vertical synchronization signal VSYNC− drives the vertical deflection circuitry within monitor electronics 79 and controls the vertical deflection of the electron beam as the horizontal scan lines progress down the face of the CRT of the display screen 10 followed by the vertical retrace from the bottom to the top scan lines.

Before describing the characteristics of cable 81, it should be noted how the design of transmit logic 71 and receive logic 75 contribute to the minimization of the skew between the various signals. As discussed hereinbefore, subjective tests determined that the total amount of skew allowable in the transmission of the signals from the display controller 13 to the monitor electronics 79 was 16 nanoseconds. This total amount of 16 nanoseconds signal skew is composed of: the skew due to transmit logic 71, the skew due to cable 81, and the skew due to receive logic 75. Transmit logic 71 and receive logic 75 are designed to minimize skew by passing all transmitted signals through single integrated circuit elements and by choosing elements with fast switching times to minimize signal propagation delay. The use of single integrated circuits insures that all gates within the integrated circuit are as close to the same temperature and voltage level as possible. It should be noted that the temperature and the voltage level may vary from place to place on a printed circuit board and both temperature and voltage level will affect the switching times of the various gates within integrated circuits.

Passing all signals through this series of single integrated circuits also minimizes the difference in propagation delay in individual gates by using all gates within a single integrated circuit as opposed to using some gates in one integrated circuit for one signal and some gates in another integrated circuit for a second signal. For example, in the preferred embodiment, if the video synchronization register 70 was comprised of two parallel integrated circuits, as opposed to the one single integrated circuit actually used, and the video signal VIDDEO+ was input to one integrated circuit and the low intensity signal LOWINT+ was input to a second integrated circuit, there is the possibility that the skew between these two signals would be increased due to the different propagation delays introduced by the gates of the first integrated circuit with respect to those of the second integrated circuit.

This difference in propagation delay between the gates of separate integrated circuits is due to the process by which the integrated circuits are manufactured and the tolerances allowable for the propagation delay of a given integrated circuit type to still be within acceptable performance specifications. For example, a typical propagation delay time for switching from a low level to a high level output for the D-type flip-flops of video synchronization register 70 may be 8 nanoseconds with a maximum propagation delay of 12 nanoseconds. Therefore, if the video signal VIDDEO+ is being switched by a first integrated circuit with a typical propagation delay time of 8 nanoseconds and the low intensity signal LOWINT+ is being switched by a second integrated circuit with a propagation delay time of the maximum of 12 nanoseconds, the skew introduced between these two signals due simply to the fact that they are in two separate integrated circuits is 4 nanoseconds. This typical 30 to 50 percent difference in propagation delay between integrated circuits of the same type is eliminated by passing all signals through a single integrated circuit in which the propagation delay between gates within the same integrated circuit is in the range of less than 5 percent.

The use of single integrated circuits for all signals also has the secondary advantage in that it makes signal etch runs on the printed circuit boards of approximate equal length thereby minimizing the amount of skew due to different length signal runs. The skew is further reduced by integrated circuits with fast switching characteristics. For example, a 5 percent tolerance within an integrated circuit switching with a propagation delay time of 20 nanoseconds results in a possible one nanosecond skew between signals, whereas an integrated circuit with a propagation delay time of 10 nanoseconds results in a possible 0.5 nanosecond skew between signals.

In the preferred embodiment, there are two types of cable 81 used. For lengths of 0 to 75 feet, cable 81 is comprised of 4 pairs of twisted wires with an outer shielding around the four pairs of wires. For a cable length of 75 to 150 feet, cable 81 is comprised of four pairs of individually shielded wires with an outer shield around the four inner shields. In both these cases the outer shielding is grounded and primarily serves the purpose of reducing RFI emissions from the cable caused by the rapidly switching signals carried by the four twisted pairs. In both the short run, less than 75 feet, and the long run, over 75 feet, it is important that the length of the signal paths of the twisted pairs be approximately equal to minimize skew introduced by different signal path lengths.

In cable 81 of 75 to 150 feet, the individual twisted pairs of wires are individually shielded as illustrated in FIG. 6 to minimize the effect of signals in one pair switching in one direction (for example: high to low) and signals in another pair switching in the other direction (for example: low to high). Without shielding the individual pairs, a signal switching in one pair will speed up the switching of a signal in another pair switching in the same direction and will slow down the switching of a signal switching in the opposite direction in another pair. This reinforcing and inhibiting of switching between signals running in parallel conductors is caused by capacitance build-up in the cable and is a function of cable length. The shielding of individual twisted pairs helps reduce this capacitance build-up. Empirical tests, in which the skew due to transmit logic 71 and receive logic 75 have been accounted for, have shown that the individual shielding is not needed for cable lengths of less than 75 feet and is required for cable lengths of 75 to 150 feet.

Another factor determining the choice of cable and the maximum length which the cable is suitable is the capacitance of the pair of twisted wires itself. Capacitance increases with the length of the cable and directly affects the charging and discharging time of the signal levels. As the charging and discharging time increases, the signal wave shape, which would otherwise be a square wave, is distorted as the signal level charges up exponentially and discharges exponentially. This charging and discharging time introduced by cable capacitance delays a signal reaching the voltage level threshold required by the receiving circuit to switch from one state to another state. If all signals are switching at the same frequency, the charging and discharging time of each signal will be the same, and no skew will be introduced between the signals. However, a fast switching signal will not have time to fully charge or discharge the twisted pair and will result in the reaching of the threshold voltage level of the receiving circuit earlier than a signal switching at a lower frequency and thus introduce skew between the signals. For example, in the preferred embodiment, the video signals VIDDEO+CD and VIDDEO−CD can switch each dot time which is approximately 50.7 nanoseconds whereas the low intensity signals HGHLTE+CD and HGHLTE−CD may only switch at one-ninth that frequency (i.e., each character cell boundary, approximately 456.3 nanoseconds each), resulting in the fact that the cable capacitance can introduce skew between the video and low intensity signals. Thus the capacitance of the cable is a factor in determining the choice of cable.

The video generation logic of FIG. 7 will now be discussed in detail. As discussed with respect to FIG. 4, the information to be displayed on the CRT 11 is retrieved from refresh memory 44 a character at a time (see FIG. 4). In the preferred embodiment, refresh memory 44 is a random access memory containing 2,048 words of 16 bits each. Of these 2,048 data locations contained in refresh memory 44, 2,000 data locations are used to contain the 2,000 characters (80 display columns times 25 display rows) displayable on CRT 11 (see FIG. 1). The format of the 16-bit refresh memory data word is shown in FIG. 8.

Figure 8:
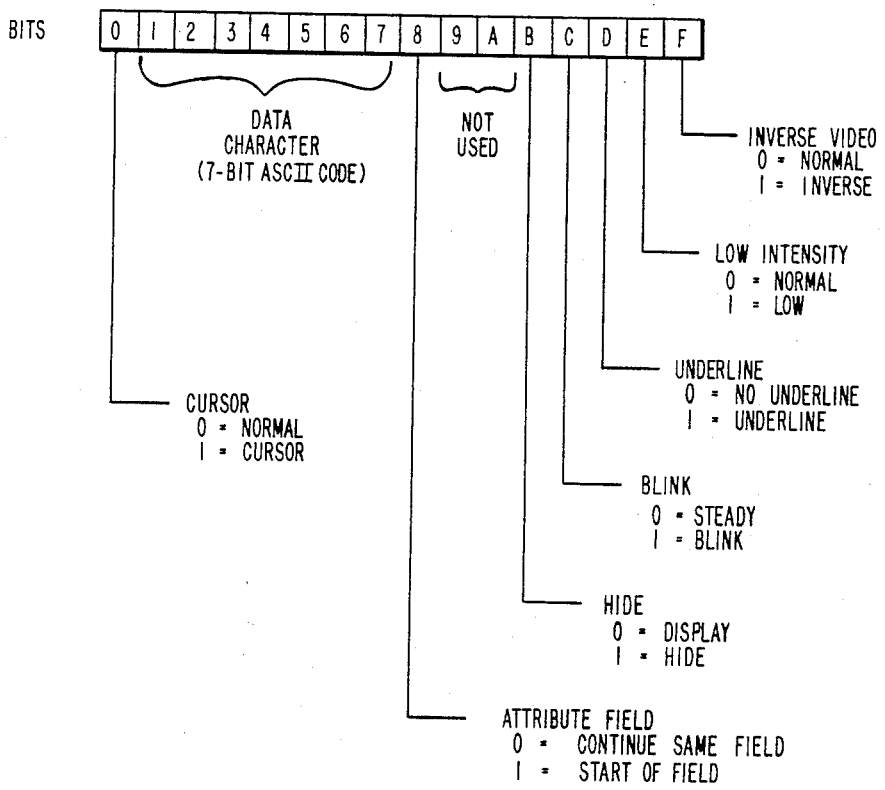
FIG. 8 is a diagram illustrating the data format of information stored in the refresh memory of the display controller.

Referring now to FIG. 8, it can be seen that bit 0 is used for cursor control. If bit 0 is a logical ZERO, the character position on the display screen corresponding to the refresh memory data word does not contain the cursor. If bit 0 is a logical ONE, the character position on the display screen of CRT 11 contains the current position of the cursor. The cursor indicates to an operator where the next character of data entered from a keyboard attached to the display controller will be placed. Bits 1 through 7 are used to store the 7-bit ASCII code which corresponds to the data character.

Bit 8 is used as an attribute field indicator. If bit 8 is a logical ZERO, it means that the data character is part of a multiple character field having all common video attributes such that the attribute bits of the 16-bit data word in refresh memory 44 of the first word of the multiple character field are to be used and the attribute bits in the current character's 16-bit data word are to be ignored. If bit 8 is a logical ONE, it means that this data character is start of a field having common video attributes and the video attributes found in bits B through F are to be used. Each character can have a unique set of video attributes by setting bit 8 to a logical ONE to indicate that each character starts a new attribute field. As will be seen below, bit 8 does not affect the interpretation of the cursor bit (bit 0) such that a cursor in a multiple character field will always be displayed.

Bits 9 and A (hexadecimal notation) are not used. Bit B is used for the hide attribute. If bit B is a logical ZERO, the data character is to be displayed on the display screen. If bit B is a logical ONE, the data character is not to be displayed on the display screen. Bit C is the blink control bit. If bit C is a logical ZERO, the character is to be displayed on the display screen in a steady (non-blinking) manner. If bit C is a logical ONE, the character is to be blinked on and off on the display screen. Bit D controls the underlining of the character. If bit D is a logical ZERO, the character displayed on the screen is not to be underlined. If bit D is a logical ONE, the character is to be displayed on the screen with an underline in scan line 12, dots 1' through 9' (see FIG. 2). Bit E is used to control the low intensity mode. If bit E is a logical ZERO, the character is to be displayed in normal brightness. If bit E is a logical ONE, the character is to be displayed in the low intensity (reduced brightness) mode. Bit F is used to control inverse video. If bit F is a logical ZERO, the character is to be displayed in the normal mode (i.e., a light character against a dark background). If bit F is a logical ONE, the character is to be displayed in the inverse video mode in which a dark character will be displayed against a light background. In the preferred embodiment, the video attribute bits (bits 8 and B through F) of the 16-bit refresh memory data word are set under control of the firmware of the display controller as the data character is entered from a keyboard and they may also be set in the data received from the computer.

Figure 7:
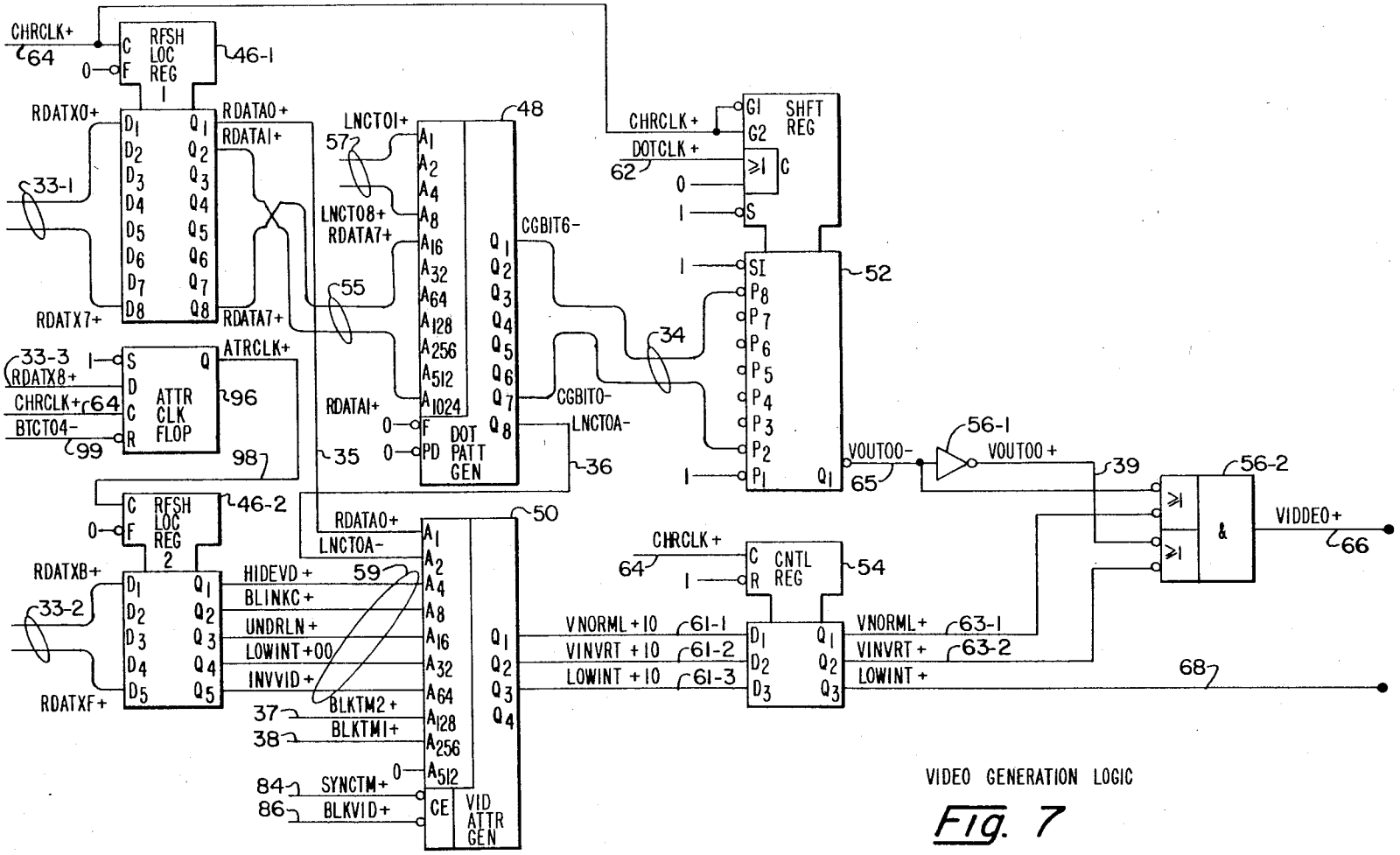
FIG. 7 is a detailed illustration of the video generation logic.

Returning now to the video generation logic shown in FIG. 7, the output of refresh memory 44 is stored in refresh local register 46 under the control of character clocking signal CHRCLK+. More specifically, the bits 0 through 7 of the refresh memory data word which contain the cursor and the 7-bit ASCII code corresponding to the data character are stored in refresh local register 1, element 46-1, and bits B through F are stored in refresh local register 2, element 46-2. Bits 0 through 7 are input to refresh local register 1, element 46-1, on lines 33-1 at inputs D1 through D8 as signals RDATX0+ through RDATX7+. Bits B through F are input into refresh local register 2, element 46-2, on lines 33-2 at inputs D1 through D5 as signals RDATXB+ through RDATXF+.

Character clocking signal CHRCLK+ on line 64 at the clock (C) input of refresh local register 1, element 46-1, is used to directly clock the cursor bit and the 7 data character bits from the 16-bit data word from the refresh memory in preparation of refreshing the next column on the display screen. Bits B through F from the 16-bit data word are clocked into refresh local register 2, element 46-2, by attribute clocking signal ATRCLK+ on line 98 at the clock (C) input only if bit 8 of the 16-bit refresh memory data word indicates that the character is the start of a video attribute field. If bit 8 of the 16-bit refresh memory data word is a logical ZERO indicating that the data character is part of a multiple character field, refresh local register 2 is not clocked and the previous video attribute bits remaining in refresh local register 2 from the character that started the video attribute field are used to control the display of the current character.

Attribute clocking signal ATRCLK+ on line 98 is generated by attribute clock flop 96 which is a D-type flip-flop. If the attribute field bit (bit 8) in the 16-bit refresh memory data word is a logical ONE, signal RDATX8+ on line 33-3 at the data (D) input of attribute clock flop 96 will be clocked into flip-flop 96 by character clocking signal CHRCLK+ at the clock (C) input and result in the setting of flip-flop 96. The setting of attribute clock flop 96 results in the Q output, signal ATRCLK+, becoming a logical ONE, which in turn results in the clocking of refresh local register 2, element 46-2. Attribute clock flop 96 is reset by signal BTCT04− at the reset (R) input during each character time before the character clocking signal CHRCLK+ occurs, thus conditioning flip-flop 96 to be set and produce the attribute clocking signal if bit 8 of the refresh memory data word indicates that the character starts a video attribute field.

The timing of character clocking signal CHRCLK+ and attribute clocking signal ATRCLK+ is such that signal ATRCLK+ lags signal CHRCLK+ by the propagation delay due to the setting of flip-flop 96. In the preferred embodiment, this results in signal ATRCLK+ lagging signal CHRCLK+ by approximately 20 nanoseconds which is not significant when compared to the 450 nanosecond character scan time. Therefore, unless indicated otherwise, the clocking of refresh memory register 2 will be referred to as being done on the character time by signal CHRCLK+.

The output of refresh local register 1, signals RDATA1+ through RDATA7+ on lines 55, is used to address dot pattern generator PROM 48. The output of refresh local register 2, signals HIDEVD+, BLINKC+, UNDRLN+, LOWINT+00, and INVVID+ on lines 59, along with signal RDATA0+ on line 35 from refresh local register 1 and signal LNCT0A+ on line 36 from dot pattern generation PROM 48 are then used to address video attribute generation PROM 50. One character time later the output of dot pattern generation PROM 48 is clocked into shift register 52 by character clocking signal CHRCLK+ on line 64 and the output of video attribute generation PROM 50 on lines 61-1 through 61-3 are clocked into control register 54 by character clocking signal CHRCLK+ on line 64. The 7-bit dot pattern used to control the generation of the dots 2' through 8' of scan lines 2 through 11 of the character cell (see FIG. 2) comes from dot pattern generation PROM 48, one scan line at a time.

Dot pattern generation PROM 48 contains 2,048 words of 8 bits per word. The 11-bit address used to retrieve the dot pattern from the dot pattern generation PROM 48 is comprised of the 7-bit ASCII code of the data character to be displayed in the character cell and the 4-bit scan line count which is a value of 0 through 12 for the 13 scan lines associated with each character cell of a row of characters. The 7-bit ASCII code for the data character appears as signals RDATA1+ through RDATA7+ on lines 55 and the 4-bit scan line count from line counter 47 (see FIG. 4) appears as signals LNCT01+ through LNCT08+ on lines 57. The 8-bit output of dot pattern generation PROM 48 is used as input to shift register 52 and as an address input to video attribute generation PROM 50. The 7 bits corresponding to character cell scan dots 2' through 8' which are signals CGBIT0− through CGBIT6− on lines 34 are parallel loaded into shift register 52 by character clocking signal CHRCLK+ on line 64. The eighth bit of the PROM word from dot pattern generation PROM 48 is used to indicate scan line 12 which is the underline scan line and is output as signal LNCT0A− on line 36. This encoding of the eighth bit of the dot pattern generation PROM data word to indicate the underline scan line (line 12) saves having to do a decode on the four signals LNCT01+ through LNCTO8+ from line counter 47 to detect scan line 12. In the preferred embodiment, dot pattern generator PROM 48 is a type 2716 PROM manufactured by Intel Corporation of Santa Clara, Calif., 95051, and described in their publication entitled *Intel Corporation Data Catalog* copyrighted 1980 which is incorporated herein by reference.

The organization of the data in dot pattern generation PROM 48 can be better appreciated by referencing FIG. 9. FIG. 9 illustrates the contents of the 8-bit data words in the PROM corresponding to locations addressed 40F through 422 (hexadecimal addresses). Each 8-bit data word in the dot pattern generation PROM 48 is precoded with a 7-bit dot pattern which corresponds to one scan line (dots 2' through 8') and the 8th bit being used as a signal to whether this dot pattern data word in the PROM is associated with the twelfth scan line (underline line) of the character cell. The dot pattern is arranged in the dot pattern generation PROM 48 such that the 7 most significant bits of the address correspond to the ASCII code for the data character and the 4 least significant bits correspond to the scan line count of the data cell. Therefore, the data words in locations 410 through locations 41F contain the dot pattern associated with generating an upper case letter "A". It being noted that the ASCII code for the character "A" is 41 (hexadecimal). The data words of dot pattern generation PROM 48 are precoded such that a logical ZERO appears in bits 1 through 7 for each dot which is to be illuminated on the display screen when the character is displayed in normal mode. Therefore, PROM locations 410 through 41C in FIG. 9 correspond to the character cell illustrated in FIG. 2.

Bit 8 of the PROM data words contains a logical ZERO if the data word corresponds to the twelfth scan line of the character cell and therefore bits 8 of data word 41B is a logical ZERO. All other bits of the PROM data word not indicated to be a logical ZERO in FIG. 9 are precoded as a logical ONE. For illustration purposes, these logical ONEs are not illustrated in FIG. 9 to make the dot pattern of the data character more easily recognizable.

Because there are only 13 lines per character cell which are displayed on the screen and the line count which is binary encoded on signal lines LNCT01+ through LNCT08+ on lines 57 only go from the value of 0 through 12 (0 through C hexadecimal), the fourteenth, fifteenth and sixteenth data words in each group of 16 data words in the dot pattern generation PROM are never addressed and therefore are not retrieved and output on the outputs Q1 through Q8 of dot pattern generation PROM 48 (i.e., locations 41D, 41E, and 41F in FIG. 9 associated with the character "A" are not accessed and therefore their content is not used). Locations 400 through 40F contain the dot patern for the character "@" (ASCII code 40, hexidecimal) and locations 420 through 42F contain the dot pattern for the upper case letter "B" (ASCII code 42, hexidecimal) a portion of which is shown in FIG. 9.

Dot pattern generation PROM 48 is always enabled by the logical ZERO appearng at the function (F) input and another logical ZERO signal being applied to the power down (PD) input such that the PROM is free running thereby provding at its Q outputs an 8-bit data word which corresponds to the 11-bit binary encoded address presented at its address (A) inputs. The timing in the video generation logic is such that the availability of the address to dot pattern generation PROM 48 occurs at the beginning of one character time and the dot pattern output of PROM 48 is not used until the beginning of the next character time. In the preferred embodiment, the time between character times is approximately 450 nanoseconds. Although the dot pattern output by dot pattern generator PROM 48 is not used until the next character time, the scan line 12 indicator signal LNCT0A− on line 36 is used as an address input to video attribute generation PROM 50 so it must be available to that video attribute generation PROM 50 can be access during the same character time period.

The video attribute generation PROM 50 combines the 9 signals which affect the video attribute of the character cell to be displayed on the CRT 11 and provides 3 video control output signals. The 9 video attribute controlling signals are used as address inputs into video attribute generation PROM 50 to retrieve a 4-bit data word which appears at the Q outputs. In the preferred embodiment, video attribute PROM 50 is a type 82S137 PROM which contains 1,024 words of 4 bits each and is manufactured by Signetics Corporation of Sunnyvale, Calif., 94068, and is described in their publication entitled *Signetics Data Manual* copyrighted 1976 which is incorporated herein by reference. In the preferred embodment, only 512 words of the 1,024 data words available in video attribute generation PROM 50 are used because only 9 bits of the 10 bits address are used with a logical ZERO being applied to address input A512. Further, in the preferred embodiment only 3 bits of each data word are used and the 4th bit which appars at the Q4 output is not used.

Figures 10, 11:
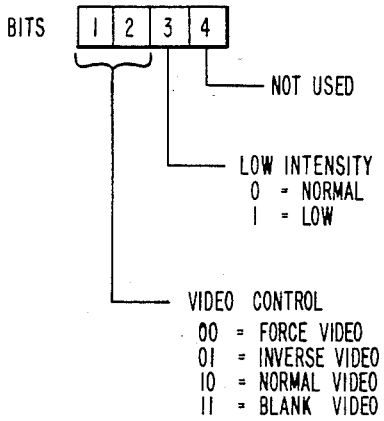
FIG. 10 is a diagram illustrating the data format of the data which is precoded in the video attribute generator of FIGS. 4 and 7.
FIG. 11 is an illustration showing four states on the display screen for a character cell containing the character A in a blinking data field and also containing the cursor.

The format of the data words of the video attribute generation PROM 50 is illustrated in FIG. 10 which shows that bit 3 is used to control the intensity of the dot displayed on the CRT screen and if a logical ZERO, the intensity of the dot is displayed in the normal brightness and if a logical ONE, it is displayed in the low intensity (reduced brightness). This low intensity signal appears as signal LOWINT+10 on line 61-3 at the Q3 output. Bits 1 and 2 appear as signal VNORML+10 and signal VINVRT+10 on lines 61-1 and 61-2 at the Q1 and Q2 outputs respectively. Bits 1 and 2 are used to control the video output and the 2 bits are binary encoded to provide for: the forcing of the video signal, the inverting of the video signal, the blanking of the video signal, or a normal video signal. As will be seen hereinafter, these two video control signals (VNORML+10 and VINVRT+10) are used to control the video signal VOUT00− output at the Q1 output of shift register 52 which is derived from the dot pattern generation PROM 48.

Video attribute generation PROM 50 is precoded such that for each unique 9-bit address which is determined by the 9 video attribute signals which are input into address bits A1 through A256, a unique 4-bit data word is output which reflects whether a dot is to be displayed on the screen in low intensity or in normal intensity; whether a dot is to be forced on the screen independent of what is called for by the dot pattern generator; whether the dot called for by the dot pattern generator is to be blanked (inhibited); whether the dot pattern called for by the dot pattern generator is to be inverted; or whether the dot called for by the dot pattern generator is to be displayed in the normal video mode. Without the use of video attribute generation PROM 50, a large amount of combinational logic would be required to allow all 9 video attribute signals to interact with the video signal VOUT00− output by shift register 52. In addition, the use of a PROM, instead of combinational logic, allows the hardware designer greater flexibility in determining the results of the interaction of the video attribute signals which would not otherwise be possible with hardwired combinational logic. To change the result of attribute interaction, the data of video attribute generation PROM 50 need only be recoded. Further, by generating 3 video control signals in video attribute generation PROM 50 the amount of combinational logic between development of the video signal in shift register 52 and the final video signal presented to transmit logic 71 is reduced so that the signal delays do not exceed the dot time period of 50 nanoseconds of the preferred embodiment.

The 9 video attributes which are used to address video attribute generation PROM 50 controls the output of PROM 50 in the following manner. The cursor attribute which is represented by signal RDATA0+ on line 35 from refresh local register 1, element 46-1, when a logical ONE indicates that the cursor is in the position that the present character cell and any data entered from a keyboard will be entered into this character cell position. Normally, the cursor is displayed on the display screen as a blinking underline of the data character within the character cell. That is, scan line 12 of the character cell where the cursor is located blinks on and off (dots 1' through 9'). Thus when bit 1 of the 16 bit data word from the refresh memory 44 indicates that the cursor is associated with the current character cell being displayed and signal LNCT0A− on line 36 from dot pattern generation PROM 48 indicates that this is scan line 12, the data word retrieved from video attribute generation PROM 50 will have bits 1 and 2 set to the logical ZERO state to force the video output signal VIDDEO+ on line 66 to be a logical ONE, thereby forcing a dot to appear on the display screen and generate the cursor underline. Because any character cell in which the cursor can appear could be underlined it is desirable to distinguish the case of a cursor appearing in a character cell without an underline and a cursor appearing in a character cell with an underline. Therefore, the video attribute generation PROM 50 has been precoded such that the data words in PROM 50 addressed by having address bit A1 a logical ONE and address bit A6 a logical ONE, will result in the blinking of the character cell as a whole and not just a blinking underline.

The line 12 indicator which is input into address input A2 of video attribute generation PROM 50 will be a logical ZERO when scan line 12 is being refreshed on the display screen. Thus, when signal LNCT0A− on line 36 from dot pattern generation PROM 48 is a logical ZERO, it indicates that the 12th scan line is being scanned and if the cursor is located in the current character cell, the video output should be forced to display a blinking underline or if the underline attribute is set for the current character which is indicated by signal UNDRLN+ from the Q3 output of refresh local register 2, element 46-2, being a logical ONE, the video output will also be forced. In the normal case, the scan line 12 and underline or cursor attributes are combined by precoding video attribute generation PROM 50 data words addressed by them to have bits 1 and 2 be logical ZEROs so that signals VNORML+ and VINVRT+ on lines 63-1 and 63-2 will force the video output by making the video signal VIDDEO+ on line 66 a logical ONE. If a character cell contains an underline and the character cell is to be displayed in the inverse video mode, then the video attribute generation PROM 50 is precoded such that the output will blank out line 12. This is done by making signal VNORML+10 and signal VINVRT+10 logical ONEs.

If signal HIDEVD+ at the A4 address input of video attribute generation PROM 50 is a logical ONE, it indicates that the character data within the character cell is not to be displayed. Therefore in the case of normal video, the video attribute generation PROM 50 data words are precoded such that signal VNORML+10 and signal VINVRT+10 will be logical ONEs, thereby blanking the video output from shift register 52. This blanking of the video will be done for all scan lines except scan line 12 which, if underlined, will be forced such that the underline will appear on the display screen. If the character cell whose data is to be hidden is being displayed in the inverse video mode, then instead of blanking video as is done in the normal case, the video output is forced by making signal VNORML+10 and signal VINVRT+10 logical ZEROs.

If signal BLINKC+ at the Q2 output of refresh local register 2, element 46-2, is a logical ONE at the A8 address input of video attribute generation PROM 50, then the data character and underline and the character cell are to be blinked. This character cell blinking is done in conjunction with signal BLKTM2+ on line 37 at the A128 address input of video attribute generation PROM 50. When signal BLKTM2+ is a logical ZERO, the data character and underline are not to be displayed and this is done by precoding the data words of video attribute generation PROM 50 such that the VNORML+10 and VINVRT+10 signals are logical ONEs, thereby blanking the video output on signal VIDDEO+ on line 66.

Within the display terminal of the preferred embodiment, there are 2 blink rates: one blink rate is controlled by signal BLKTM2+ on line 37 and the other blink rate is controlled by signal BLKTM1+ on line 38. Signal BLKTM2+ is used to control the blinking of data and changes from a logical ONE to a logical ZERO at a rate that is half the rate of signal BLKTM1+. Signal BLKTM1+ is used to control the blinking of the cursor on the display screen such that a cursor wll blink at twice the rate of a blinking data cell. Both of these signals BLKTM1+ and BLKTM2+ in the preferred embodiment are controlled by firmware which sets them to a logical ONE and logical ZERO state at predetermined rates.

As described above, signal UNDRLN+ at the address A16 input of video attribute generation PROM 50 is used to control whether an underline appears within the character cell on scan line 12. Signal LOWINT+00 in a logical ONE state indicates that the character is to be displayed as a series of low intensity dots on the display screen. Usually this signal is not modified and video attribute generation PROM 50 is precoded such that in most cases, if the PROM data word selected by address input A32 is in a logical ONE state, it will result in retrieving a PROM data word with bit 3 being a logical ZERO such that signal LOWINT+10 on line 61-3 will be a logical ONE which in turn will result in the output of control register 53, signal LOWINT+ on line 68, being a logical ONE. This in turn will result in the dots on the display screen being displayed in the low intensity mode. However, there are several cases in which although the dot making up the data character with the character cell are displayed in the low intensity, it has been found desirable to display other dots within that cell in the normal intensity. For example, if the cursor is located in a character cell to be displayed in the low intensity mode, the cursor displayed as an underline on scan line 12 is displayed in the normal intensity mode and the rest of the scan lines of the character cell are displayed in the low intensity mode. By displaying the underline in normal intensity mode in low intensity cells, the cursor is more visable to the operator. Therefore, the data words in video attribute generation PROM 50 which are retrieved when signal RDATA0+ is a logical ONE (indicating that this cell contains the cursor) and signal LNCT0A− is a logical ZERO (indicating that this is the 12th scan line) and although signal LOWINT+00 is a logical ONE (indicating that the data is to be displayed in a low intensity) those data words are precoded such that bit 3 will be a logical ZERO, thereby making signal LOWINT+10 on line 61-3 a logical ZERO and forcing the underline to be displayed in the normal intensity.

Signal INVVID+ at the A64 address input of video attribute generation PROM 50 when in the logical ONE state indicates that the character cell is to be displayed in the inverse video mode. Therefore, video attribute generation PROM 50 is precoded such that it will normally result in signal VNORML+10 being a logical ZERO and signal VINVRT+10 being a logical ONE, thereby inverting the output of what would otherwise occur for signal VIDDEO+ on line 66.

Signals BLKTM2+ and signal BLKTM1+ at the A128 and A256 inputs of video attribute generation PROM 50 as indicated above are used to control blink rates and toggle between logical ONE and logical ZERO at two distinct rates so that the cursor will blink at one rate and the data will blink at a different rate. FIG. 11 illustrates the four possible cases of combining the blinking of the character data and the cursor. When signal BLKTM2+ is a logical ZERO, the character data is not to be displayed; when a logical ONE, the character data is to be displayed. When signal BLKTM1+ is a logical ZERO, the cursor is not to be displayed; when a logical ONE, the cursor is to be displayed. Therefore, if the cursor is currently located in a character cell where data is to be blinked, the character cell displayed on the display screen in the four different states as shown in FIG. 11. When signal BLKTM2+ and BLKTM1+ are both logical ZEROs, the data words of video attribute generation PROM 50 are produced such that nothing is displayed on the display screen. When signal BLKTM2+ is a logical ZERO and signal BLKTM1+ is a logical ONE, the data words of video attribute generation PROM 50 are precoded such that only the underline in scan line 12 is displayed on the display screen. When signal BLKTM2+ is a logical ONE and signal BLKTM1+ is a logical ZERO, the data words of video attribute generation PROM 50 are pecoded such that only the character data will appear on the display screen. When signal BLKTM2+ is a logical ONE and signal BLKTM1+ is a logical ONE, both the character data and the underline for the cursor will appear on the display screen. In the preferred embodiment, the blink rate for each of these four states is chosen to be one-fourth of a second such that signal BLKTM1+ changes logical states each one-fourth of a second and signal BLKTM2+ changes logical states every half second.

If the character on the display screen is being displayed in the inverse video mode, blink timing signal BLKTM2+ and BLKTM1+ interact with the inverse video signal INVVID+ such that when the information is to be blinked (hidden) instead of outputting a blanking video signal in bits 1 and 2 of the video attribute generation PROM 50 data words, a forcing video signal is produced by setting bits 1 and 2 to a logical ONE thereby making signal VNORML+10 and signal VINVRT+10 logical ONEs at the Q1 and Q2 outputs of video attribute generation PROM 50.

Unlike the dot pattern generation PROM 48 which is free running by having logical ONE signals at the enable output (F) and power down (PD) inputs thereby providing that the 8-bit data word will always appear at the Q1 through Q8 outputs in response to an 11-bit address appearing at the address inputs, the video attribute generation PROM 50 is enabled by signal SYNCTM+ on line 85 and signal BLKVID+ on line 86 at the chip-enabled inputs being both logical ZEROs. Signal SYNCTM+ is generated by refresh address generator 53 (see FIG. 4) such that it will be set to the logical ONE state (thereby disabling the output of video attribute generation PROM 50) when the electron beam of the raster scan is making a horizontal retrace or a vertical retrace. By setting signal SYNCTM+ to a logical ONE during retrace, and tying the Q1 signal VNORML+10 and the Q2 output signal VINVRT+10 to pull up resistors (not shown) thereby forcing them to the logical ONE state during retrace, the video output signal VIDDEO+ on line 66 will be a logical ZERO thereby assuring that the electron beam will not illuminate any of the phosphorous on the CRT 11 display screen. Signal BLKVID+ at the other chip-enabled (CE) input of video attribute generation PROM 50 is set to the logical ONE state and thereby disabling the output of PROM 50 and forcing the video to a blank, in response to other logic not shown when it is desired to blank to CRT display.

Shift register 52 is parallel loaded from the dot pattern generation PROM 48 at the beginning of a character time and is then shifted one bit at a time for the next 8 dot times to serially provide dots for dots 1' through 9' of the scan line of a character cell. In the preferred embodiment, shift register 52 is of the type SN74166 manufactured by Texas Instruments Incorporated of Dallas, Tex. Under the control of the G1 and G2 clocking inputs which are connected to character clock signal CHRCLK+, 8 bits are loaded in parallel at the P1 through P8 inputs. Inputs P2 through P8 are connected to the output of dot pattern generation PROM 48 such that they receive the dot pattern for a scan line for dots associated with dots 2' through 8' of a character cell (see FIG. 3). Input P1 is connected to a logical ONE to set the dot 1' of the scan line to a logical ONE such that in a normal case there will be no dot generated for dot 1' of a scan line. The serial input (SI) is also connected to a logical ONE such that as the 8 bits within the shift register are shifted, a logical ONE will be shifted into the vacated bit positions and thereby generate a logical ONE as output for dot 9' of the character cell scan line. It being noted that the output signal VOUT00− will be appearing at the Q1 output as a logical ONE for each dot which is not to be illuminated on the screen and as a logical ONE for each dot which is to be illuminated on the screen because of the dot pattern stored in dot pattern generation PROM 48 is stored with logical ZEROs for dot positions which are to be illuminated. After being parallel loaded at a character time, the shift register 52 is serially shifted so that a single bit appears at the Q1 output each time dot clocking signal DOTCLK+ on line 64 transitions to the logical ONE state at the serial clock (C) clocking input. The overriding clear input (S) of shift register 52 is set to a logical ONE because it is not used.

The output of video attribute generation PROM 50 is input and latched in control register 54 by character clocking signal CHRCLK+ on line 64 at the clock (C) input. The reset (R) input of control register 54 is set to a logical ONE thereby inhibiting the reset of the register. The 3 video control signals VNORML+10, VINVRT+10, and LOWINT+10 at the D1, D2, and D3 inputs respectively of control register 54 are clocked into the register at the beginning of a character time and therefore remain available at the Q1, Q2, and Q3 outputs respectively for the full period of the character generation. That is, signals VNORML+ on line 63-1, signal VINVRT+ on line 63-2, and signal LOWINT+ on line 68 remain constant for a full character time because the attributes that affect the generation of the dots within a character cell apply to all 9 dots (dot 1' though 9' of FIG. 2) of the character cell.

The low intensity signal LOWINT+ on line 68 goes directly to transition logic 71 (see FIG. 4) whereas signal VNORML+ and signal VINVRT+ are sent to AND− OR− INVERTER gate 56-2 which outputs video signal VIDDEO+ on line 66. Dot video signal VOUT00− on line 62 is inverted by inverter 56-1, the output of which is signal VOUT00+. Signals VOUT00+ and VOUT00− are also input to AND− OR− INVERTER gate 56-2 which in the preferred embodiment is a type SN74S51 integrated circuit manufactured by Texas Instruments Inc. of Dallas, Tex. As discussed hereinbefore, the video control signals VNORML+ and VINVRT+ (corresponding to signals VNORML+10 and VINVRT+10) are binary encoded to provide the four functions such that the video signal output by shift register 52 can be normal (signal VIDDEO+ will be a logical ONE if signal VOUT00+ is a logical ONE), inverted (signal VIDDEO+ will be a logical ZERO if signal VOUT00+ is a logical ONE), forced (signal VIDDEO+ will be a logical ONE, independent of the state of signal VOUT00+), or blanked (signal VIDDEO+ will be a logical ZERO, independent of the state of signal VOUT00+). As described hereinbefore, the two output signals VIDDEO+ on line 66 and the low intensity signal LOWINT+ on line 68 are then clocked into video sync register 70 (see FIG. 6) each bit time to maintain synchronization as the signals are transmitted to display monitor 77 (see FIG. 4).

The timing of the video generation logic is such that the output of dot pattern generation PROM 48 is clocked into shift register 52 and the output of video attribute generator PROM 50 is clocked into control register 54 one character time after their generating inputs became available at the output of refresh local register 1, element 46-1, and refresh local register 2, element 46-2 (assuming that refresh local register 46-2 was clocked because bit 8 of the refresh memory data word contained a logical ONE indicating that the character was the start of a video attribute field). The data inputs of refresh local registers 1 and 2 are available at the 16-bit data word output from refresh memory 44 one character clock period after the refresh memory address was available at the output of refresh address generator 53 (see FIG. 4). For example, at the time the address of the 16-bit refresh memory data word corresponding to the character cell determined by the intersection of column 33 and row 2 (see FIG. 1) becomes available at the output of refresh address generator 53, the 16-bit data word corresponding to the character cell in column 32 of row 2 is available at the output of refresh memory 44 and is clocked into refresh local register 46 and the dot pattern generated by dot pattern generation PROM 48 and the video control signals generated by video attribute generation PROM 50 for column 31 of row 2 are respectively clocked into shift register 52 and control register 54. That is, while a character in column 31 is being displayed on the display screen of CRT 11, the dot pattern and video attributes associated with column 32 are being generated, the data word in refresh memory 44 for column 33 is being accessed.

While the present invention has been described in terms of a CRT display terminal in which the characters displayed on the screen may be modified by the attributes of cursor, hide, blink, underline, inverse video and low intensity, it is envisioned that many of the principles of the present invention can be employed with respect to different types of display devices and different types of attributes. Further, it will be appreciated by those skilled in the art that many changes may be made in the illustrative embodiment without departing from the spirit and scope of the invention. For example, multiple intensities or color on the display screen could be provided by using more bits in the refresh memory data word to indicate different intensity levels or colors.

While the present invention has been particularly described and shown with reference to the preferred embodiment, it will be understood by those skilled in the art that the foregoing and other changes in form, dimension, and detail may be made herein without departing from the spirit and scope of the invention.

Having described the invention, what is claimed as new and novel and for which it is desired to secure Letters Patent is:

1. A video character generation system in a display controller for producing a video signal to be used by a display monitor to produce video information on a display screen of said display monitor in response to a plurality of information words stored in a refresh memory of said display controller, wherein said display controller includes raster scan logic having a column counter for producing a character clocking signal and a line counter for producing a line count indicative of the scan line being refreshed on said display screen, said video character generation system comprising:

a. a character dot pattern generation means, coupled to said refresh memory, for producing a serial dot pattern signal corresponding to a raster scan line of one character of said video information in response to a unit of encoded character information contained in each of said plurality of information words retrieved from said refresh memory and said line count from said line counter;

b. an attribute generation means, coupled to said refresh memory, for receiving a plurality of attribute signals encoded in each of said plurality of information words, said plurality of attribute signals for controlling how one or more associated characters of video information is to be displayed on said display screen, said attribute generation means for generating a plurality of video control signals;

c. a control register for storing said plurality of video control signals, said control register being clocked by said character clocking signal; and d. video logic for combining said serial dot pattern signal with some of said video control signals from said control register to produce said video signal for each of said plurality of information words.

2. The apparatus as in claim 1 wherein said attribute generation means is a first precoded memory containing a plurality of data words, each of said data words containing a plurality of bits with each of said plurality of bits dedicated to produce a signal corresponding to one of said video control signals and wherein said data words are accessed from said first precoded memory using said attribute signals as address bits.

3. The apparatus as in claim 2 wherein said first precoded memory is a PROM memory.

4. The apparatus as in claim 2 wherein said video control signals comprise an intensity signal, a normal video signal, and an inverse video signal and wherein said normal video signal and said inverse video signal are binary encoded to produce four states of: video block, video normal, video force, and video inverse, wherein said video block state inhibits said serial dot pattern signal from producing said video signal so that no dot appears on said display screen, wherein said video normal state enables said serial dot pattern signal to produce said video signal so that a dot will appear on said display screen if called for by said serial dot pattern signal, wherein said video force state produces said video signal so that a dot will appear on said display screen regardless of said serial dot pattern signal, and wherein said video inverse state inverts said serial dot pattern signal to produce said video signal so that a dot will appear on said display screen if not called for by said serial dot pattern signal and a dot will not appear on said display screen if called for by said serial dot pattern signal.

5. The apparatus as in claim 4 wherein said video logic is responsive to said serial dot pattern signal generated by said character dot pattern generation means and said video normal signal and video inverse signal to produce said video signal.

6. The apparatus as in claim 5 wherein each of said plurality of information words in said refresh memory contains a bit indicating a start of attribute field and said start of attribute field bit produces a signal which is used to inhibit the clocking of a second refresh register which provides the attribute signals to said attribute generation means thereby allowing the previous attribute signals from a previous one of said plurality of information words to remain in effect to be used with a current unit of encoded character information and subsequent units of encoded character information until a subsequent one of said plurality of information words indicates that it is said start of an attribute field.

7. A method of producing a video signal for use by a display monitor connected to a display controller, said display controller having a refresh memory and a raster scan logic, said raster scan logic comprising a character counter for producing a character clocking signal, a line counter for producing line count signals and a dot counter for producing a dot clocking signal, said refresh memory containing a plurality of video data units, each of said plurality of video data units comprising a plurality of bits, a first group of said plurality of bits for encoding a data character which is to be displayed as video information on said display monitor and a second group of said plurality of bits for indicating various attributes which modify the manner in which said video information encoded in said plurality of video data units is displayed on said display monitor, which comprises the steps of:

a. clocking said first group of said plurality of bits into a first refresh local register coupled to said refresh memory, said first group of said plurality of bits being clocked into said first refresh local register by said character clocking signal;

b. clocking said second group of said plurality of bits into a second refresh local register coupled to said refresh memory, said second group of said plurality of bits being clocked by an attribute clocking signal derived from said character clocking signal;

c. generating a serial dot pattern signal by use of a character dot pattern generator coupled to said first refresh local register by using said first group of said plurality of bits and said line count signals from said line counter;

d. generating a plurality of video control signals by using a video attribute generator coupled to said second refresh local register;

e. clocking said video control signals into a control register coupled to said video attribute generator, said clocking being done by said character clocking signal; and f. combining some of said plurality of video control signals with said serial dot pattern signal in video logic coupled to said character dot pattern generator and said video attribute generator to produce a video signal for transmission to said display monitor for each of said video data units.

8. The method of claim 7 wherein said attribute clocking signal used to clock said second refresh local register is produced at an output of a flip-flop clocked by said character clocking signal, said flip-flop having a data input connected to receive a signal derived from a start field bit within said second group of bits indicating that a particular video data unit containing said start field bit in a predetermined state corresponds to the start of a video attribute field.

9. The method as in claim 8 wherein a signal output by said dot pattern generator indicates if a current scan line is a scan line which must be treated in a special manner, and if so, modifies said plurality of video control signals output by said video attribute generator, said control signal from said character dot pattern generator being used in place of decoding said line count signals to determine said current scan line.

10. The method as in claim 9 wherein two signals of said plurality of video control signals are a normal video control signal and an inverting video control signal which are used to produce four states of: block, force, inverse, and normal video which are used by said video logic to modify said serial dot pattern logic signal to produce said video signal, wherein said video block state inhibits said serial dot pattern signal from producing said video signal so that no dot appears on said display monitor, wherein said video normal state enables said serial dot pattern signal to produce said video signal so that a dot will appear on said display monitor if called for by said serial dot pattern signal, wherein said video force signal produces said video signal so that a dot will appear on the said display monitor regardless of said serial dot pattern signal, and wherein said video inverse state inverts said serial dot pattern signal to produce said video signal so that a dot will appear on said display monitor if not called for by said serial dot pattern signal and a dot will not appear on said display monitor if called for by said serial dot pattern signal.

11. The method as in claim 10 wherein another of said plurality of video control signals is an intensity control signal which controls the intensity in which said video information will be displayed on said display monitor.

* * * * *